US012791262B2

(12) United States Patent
Sahoo

(10) Patent No.: US 12,791,262 B2
(45) Date of Patent: Nov. 10, 2026

(54) LOOP THERMOSIPHON ASSEMBLY

(71) Applicant: Purple Cloud Development Pte. Ltd., Singapore (SG)

(72) Inventor: Venkataraman Sahoo, Singapore (SG)

(73) Assignee: Cooler Master Co., Ltd., Taipei City (TW)

( * ) Notice: Subject to any disclaimer, the term of this patent is extended or adjusted under 35 U.S.C. 154(b) by 65 days.

(21) Appl. No.: 18/752,995

(22) Filed: Jun. 25, 2024

(65) Prior Publication Data

US 2025/0389489 A1 Dec. 25, 2025

(51) Int. Cl.
*F28D 15/02* (2006.01)
*F28D 15/04* (2006.01)

(52) U.S. Cl.
CPC ..... *F28D 15/0266* (2013.01); *F28D 15/0275* (2013.01); *F28D 15/043* (2013.01); *F28D 15/046* (2013.01)

(58) Field of Classification Search
CPC .. F28D 15/0266; F28D 15/0275; F28D 15/04; F28D 15/043
See application file for complete search history.

(56) References Cited

U.S. PATENT DOCUMENTS 5,998,863 A * 12/1999 Kobayashi ..... F28F 3/12 361/699
7,686,071 B2 * 3/2010 Silverstein ..... H01L 23/427 165/110
10,436,519 B1 10/2019 Longtin
2002/0166655 A1 * 11/2002 Sugito ..... F28D 15/0266 165/104.21
2003/0079864 A1 * 5/2003 Ohara ..... F28D 15/0266 165/104.21

(Continued)

FOREIGN PATENT DOCUMENTS

JP S61223204 A 10/1986
WO 2016134268 A1 8/2016

OTHER PUBLICATIONS

European Patent Office European Search Report, European Patent Application No. 24211148.2, dated Mar. 31, 2025, 10 pages.

(Continued)

*Primary Examiner* — Eric S Ruppert
*Assistant Examiner* — Hans R Weiland
(74) *Attorney, Agent, or Firm* — Merchant & Gould P.C.

(57) ABSTRACT

A loop thermosiphon assembly may include a thermal interface component configured to be coupled to a heat source to be cooled, a channel coupled to the thermal interface component, a first vapor channel coupled to the channel, and one or more coolant pipes coupled to the first vapor channel and the channel. The channel includes a vapor barrier and a second vapor channel. The first vapor channel is in communication with the thermal interface component via the second vapor channel. The one or more coolant pipes is in communication with the thermal interface component via the vapor barrier. The second vapor channel and the first vapor channel direct vaporized liquid coolant upwards and away from the thermal interface component and heat source, and the one or more coolant pipes and the vapor barrier direct liquefied vapor coolant downwards and toward the thermal interface component and the heat source.

20 Claims, 27 Drawing Sheets

(56) References Cited

U.S. PATENT DOCUMENTS

| | | | | |
|---|---|---|---|---|
| 2005/0257918 | A1 | 11/2005 | Shih | |
| 2005/0274496 | A1* | 12/2005 | Ishii | F25B 23/006 257/E23.088 |
| 2008/0099189 | A1* | 5/2008 | Suh | F28D 15/0266 165/104.21 |
| 2010/0071880 | A1* | 3/2010 | Kim | F28D 15/0266 165/104.26 |
| 2011/0048676 | A1* | 3/2011 | Toyoda | F28D 1/05366 165/104.21 |
| 2011/0088875 | A1* | 4/2011 | Hou | F28D 15/0266 165/104.26 |
| 2011/0192574 | A1* | 8/2011 | Yoshikawa | H01L 23/427 165/104.21 |
| 2012/0312506 | A1 | 12/2012 | Uchida | |
| 2013/0167530 | A1 | 7/2013 | Hsieh | |
| 2015/0216079 | A1* | 7/2015 | Kondou | F28D 15/046 165/104.21 |
| 2023/0047466 | A1* | 2/2023 | Jiang | F28D 15/0266 |
| 2025/0237440 | A1* | 7/2025 | Nelson | F28D 15/0266 |

OTHER PUBLICATIONS

Search Report for TW Patent Application No. 113148979, dated Apr. 28, 2025, 1 page.
Office Action for TW Patent Application No. 113148979, dated May 2, 2025, 2 pages.

* cited by examiner

LOOP THERMOSIPHON ASSEMBLY

TECHNICAL FIELD

The present disclosure relates to heat-transfer components and assemblies, and more particularly, but not limited to, loop thermosiphon assemblies.

BACKGROUND OF THE INVENTION

Loop thermosiphons (LTS) or loop thermosyphons are passive, closed loop, two-phase thermal management systems, where a liquid coolant undergoes phase changes (vaporization and condensation) and the system has self-sustaining motion driven by pressure differences between hot and cold regions and gravity. Vaporized liquid coolant and liquified vapor coolant move in opposing directions via opposing coolant lines creating a cyclic liquid coolant flow from the hot regions to the cold regions and back.

Generally, loop thermosiphons may include an evaporator, a condenser, a riser, and a downcomer. Heat is absorbed from a heat source by the evaporator causing liquid coolant within the evaporator to vaporize. The vaporized liquid coolant is transported to the condenser via the riser. The condenser is where the vaporized liquid coolant releases heat, typically to a heat sink or other cooling mechanism(s). As the vapor cools in the condenser, it condenses back into a liquid state. Liquified vapor coolant is transported to the evaporator via the downcomer.

Properties of liquid coolants, filing ratios, aspect ratios, heat loads, inside pressures, material properties, and dimensions of loop thermosiphons are all factors that may negatively affect the thermal performance of loop thermosiphons. Dry out may easily occur with high heat flux and low fill ratios. Flooding may occur with large fill ratios, which would limit maximum heat flow rates. Thus, raising the filling ratio and the coolant flow rate to enhance the efficiency of loop thermosiphons while preventing dry out and flooding continues to remain challenging.

SUMMARY OF THE INVENTION

The present disclosure provides a loop thermosiphon assembly with higher heat transfer rate.

The loop thermosiphon assembly of a first configuration includes a thermal interface component, a channel, a first vapor channel, and one or more coolant pipes. The thermal interface component includes a liquid coolant and is configured to be coupled to a heat source to be cooled. The channel includes a vapor barrier and a second vapor channel and is coupled to the thermal interface component. The first vapor channel is coupled to the channel and the one or more coolant pipes is coupled to the first vapor channel. The first vapor channel is in communication with the thermal interface component via the second vapor channel. Each of the one or more coolant pipes has an input end and an output end. The input end of the one or more coolant pipes is in communication with the second vapor channel via the first vapor channel. The vapor barrier is coupled to the output end of the one or more coolant pipes. The thermal interface component is in communication with the output end of the one or more coolant pipes via the vapor barrier. The second vapor channel and the first vapor channel direct vaporized liquid coolant upwards and away from the thermal interface component and the heat source, and the one or more coolant pipes and the vapor barrier direct liquefied vapor coolant downwards and toward the thermal interface component and the heat source.

In some aspects, the techniques described herein relate to a loop thermosiphon assembly, wherein the thermal interface component includes a flat interface surface and a heat exchange chamber. The heat exchange chamber is opposite the flat interface surface. The flat interface surface is in thermal communication with the heat source.

In some aspects, the techniques described herein relate to a loop thermosiphon assembly, wherein the thermal interface component includes a cold plate formed with a metal.

In some aspects, the techniques described herein relate to a loop thermosiphon assembly, wherein the heat exchange chamber includes a plurality of heat transfer fins.

In some aspects, the techniques described herein relate to a loop thermosiphon assembly, wherein the plurality of heat transfer fins includes one or more pin fins. The one or more pin fins is substantially perpendicular to the heat source.

In some aspects, the techniques described herein relate to a loop thermosiphon assembly, further including a heat exchanger coupled to the one or more coolant pipes, the heat exchanger including a plurality of stacked horizontal fins.

In some aspects, the techniques described herein relate to a loop thermosiphon assembly, wherein the one or more coolant pipes includes fourteen one or more coolant pipes.

In some aspects, the techniques described herein relate to a loop thermosiphon assembly, wherein the first vapor channel and the channel define a vapor chamber. The vapor chamber includes a first side, a second side, a third side and a fourth side. The first side is coupled to the second side at a perimeter edge of the first side. The first side is coupled to the fourth side at a perimeter edge opposite the perimeter edge coupled to the second side. The second side is coupled to the third side at a perimeter edge opposite the perimeter edge coupled to the first side. The third side is coupled to the fourth side at a perimeter edge opposite the perimeter edge coupled to the second side. Two coolant pipes of the fourteen one or more coolant pipes are coupled to at least one of the first side, the second side, the third side, and the fourth side. Each of the two coolant pipes include two bends in a horizontal direction enabling the two coolant pipes to protrude in opposing directions extending beyond planes of opposing perimeter edges of the at least one of the first side, the second side, the third side, and the fourth side.

In some aspects, the techniques described herein relate to a loop thermosiphon assembly, wherein the one or more coolant pipes include one or more portions directing the liquefied vapor coolant substantially perpendicular to the thermal interface component and the heat source.

In some aspects, the techniques described herein relate to a loop thermosiphon assembly, wherein the vapor barrier includes a porous lining. The porous lining includes a plurality of pores configured to enable liquified vapor coolant to be directed from the output end to the thermal interface component via the porous lining.

In some aspects, the techniques described herein relate to a loop thermosiphon assembly, wherein the porous lining includes a metal foam lining.

In some aspects, the techniques described herein relate to a loop thermosiphon assembly, wherein the heat exchange chamber includes a capillary wicking layer. The capillary wicking layer overlays surfaces of the heat exchange chamber and the plurality of heat transfer fins. The capillary wicking layer includes a plurality of capillary pores.

In some aspects, the techniques described herein relate to a loop thermosiphon assembly, wherein the porous lining is coupled to the capillary wicking layer, allowing liquified vapor coolant to flow through the plurality of pores of the porous lining to the plurality of capillary pores of the capillary wicking layer.

In some aspects, the techniques described herein relate to a loop thermosiphon assembly, wherein the capillary wicking layer includes a sintered metal wick structure.

In some aspects, the techniques described herein relate to a loop thermosiphon assembly, wherein the plurality of capillary pores has a smaller pore size than the plurality of pores.

In some aspects, the techniques described herein relate to a loop thermosiphon assembly of a second configuration, wherein the vapor barrier includes a solid barrier. The solid barrier lines the porous lining opposite the output end and is configured to separate the vaporized liquid coolant from the output end and the porous lining.

In some aspects, the techniques described herein relate to a loop thermosiphon assembly of a third configuration, wherein the vapor barrier includes a solid barrier and a chamber pocket. The chamber pocket is configured to enable liquified vapor coolant to be directed from the output end to the thermal interface component. The solid barrier is configured to separate the vaporized liquid coolant from the output end and the chamber pocket.

In some aspects, the techniques described herein relate to a loop thermosiphon assembly of a fourth configuration, wherein the vapor barrier includes a modified solid barrier and a plurality of chamber pockets. The plurality of chamber pockets includes a plurality of flow channel structures coupled to the modified solid barrier configured to enable liquified vapor coolant to be directed from the output end to the thermal interface component. The modified solid barrier is configured to separate the vaporized liquid coolant from the output end and the plurality of chamber pockets.

BRIEF DESCRIPTION OF DRAWINGS

Unless specified otherwise, the accompanying drawings illustrate aspects of the innovative subject matter described herein. Referring to the drawings, wherein like reference numerals indicate similar parts throughout the several views, several examples of loop thermosiphon assemblies incorporating aspects of the presently disclosed principles are illustrated by way of example, and not by way of limitation.

DETAILED DESCRIPTION

Figure 1A:
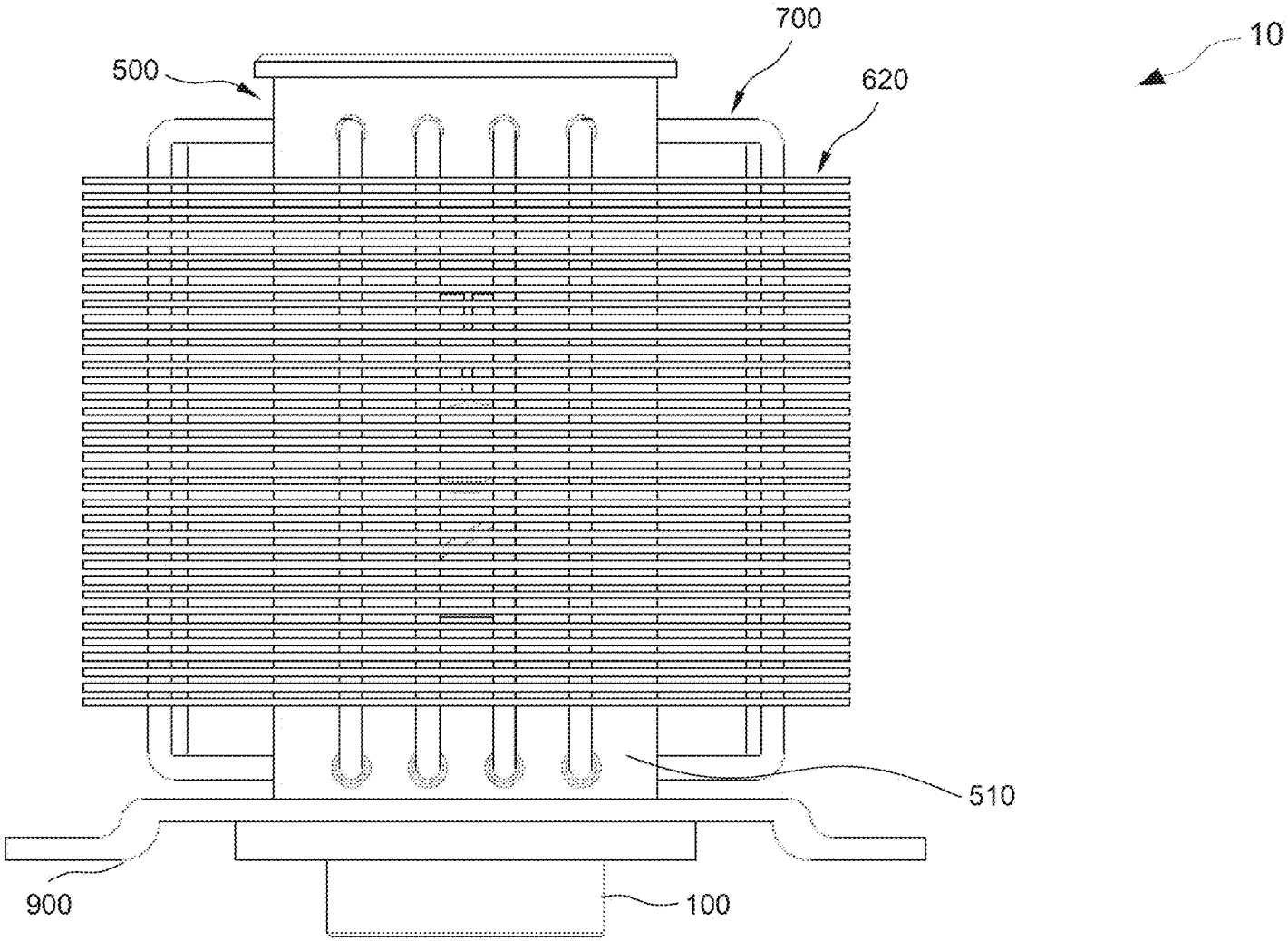
FIG. 1A illustrates a perspective view of a loop thermosiphon assembly, in accordance with various embodiments of the present disclosure.
Figure 1B:
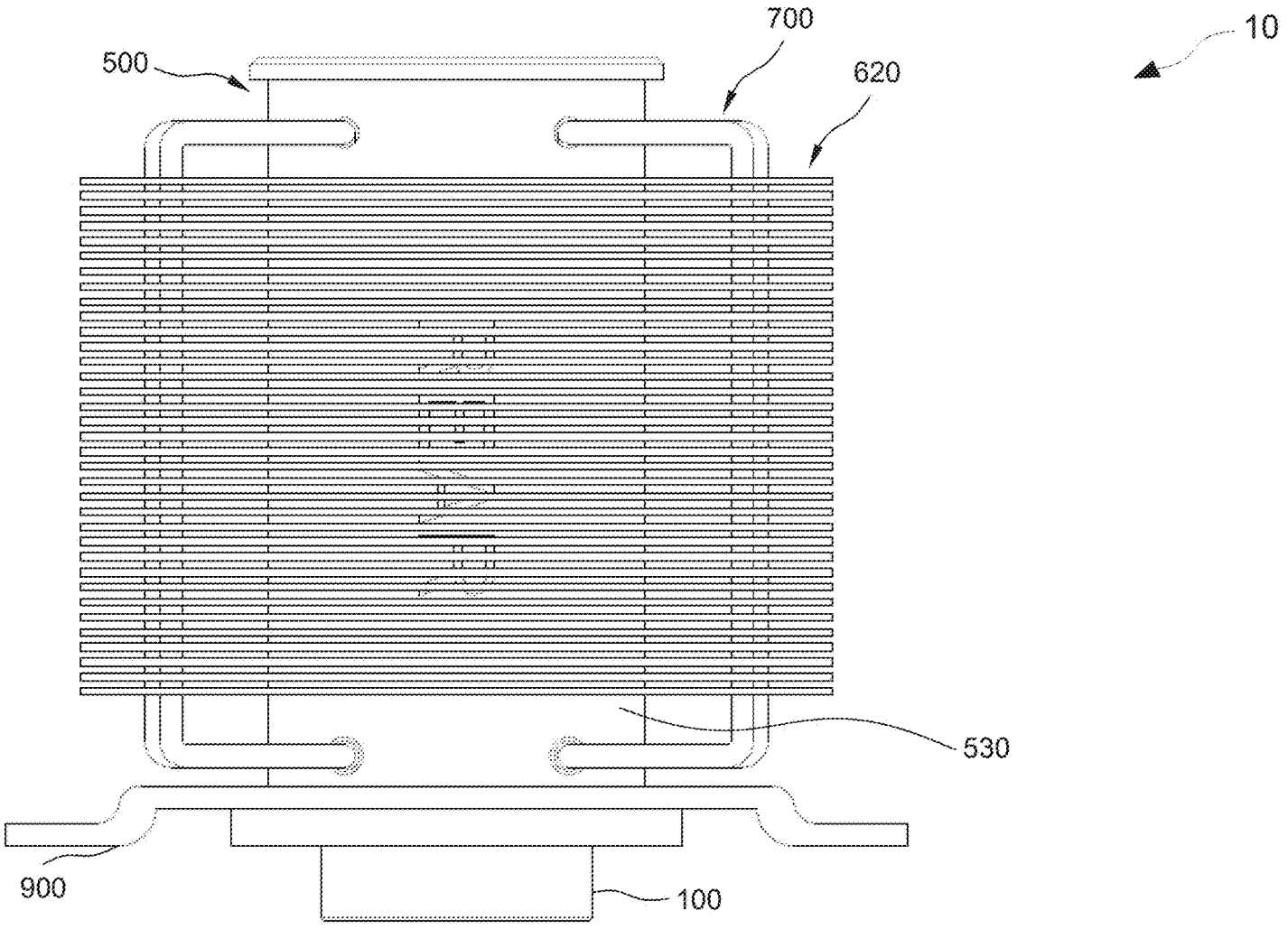
FIG. 1B illustrates another perspective view of the loop thermosiphon assembly of FIG. 1A, in accordance with various embodiments of the present disclosure.
Figure 1C:
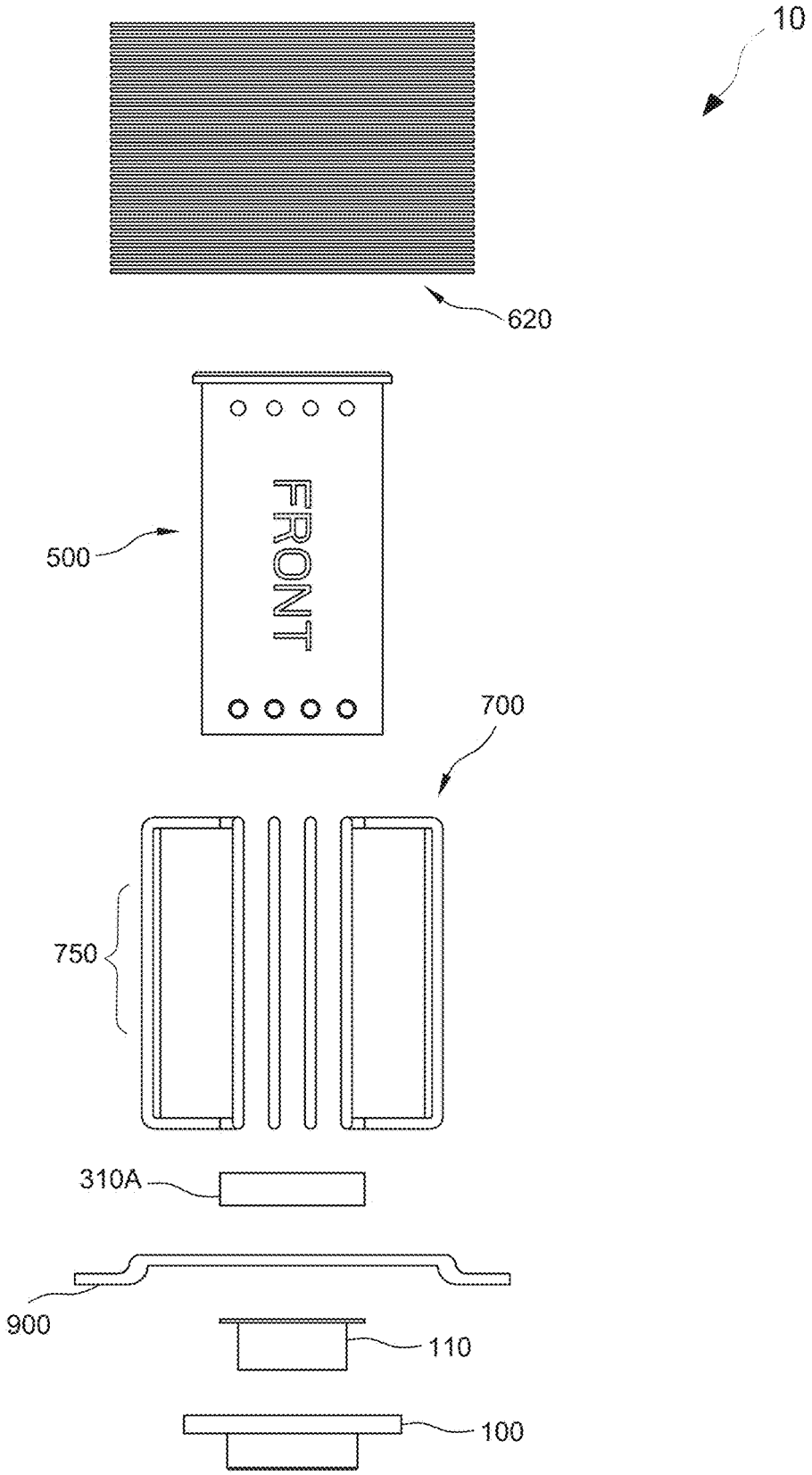
FIG. 1C illustrates an exploded view of the loop thermosiphon assembly of FIG. 1A, in accordance with various embodiments of the present disclosure.
Figure 1D:
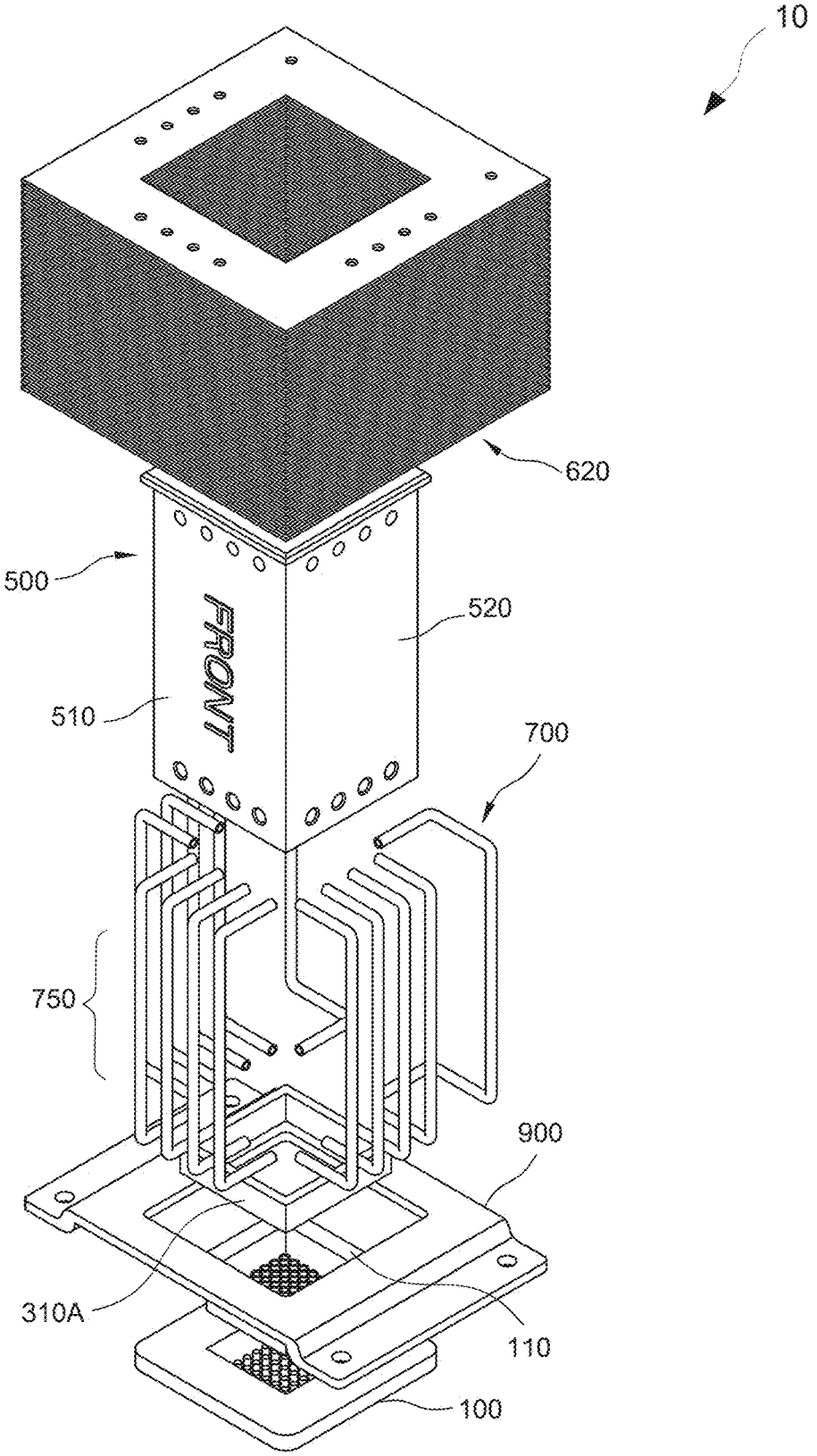
FIG. 1D illustrates another exploded view of the loop thermosiphon assembly of FIG. 1A, in accordance with various embodiments of the present disclosure.
Figure 2A:
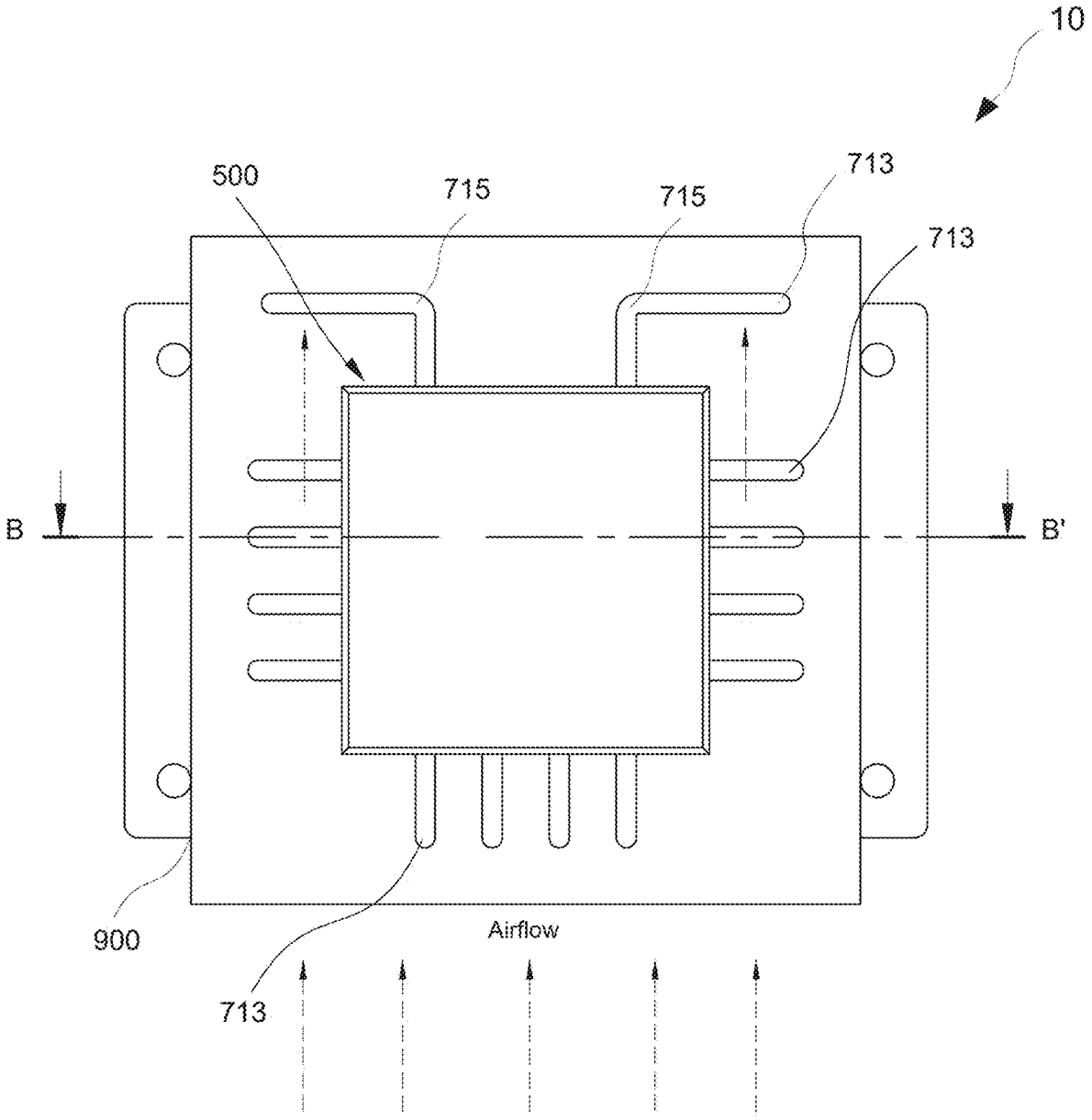
FIG. 2A illustrates a perspective view of the loop thermosiphon assembly of FIG. 1A and a cross-sectional view B-B' line, in accordance with various embodiments of the present disclosure.
Figure 2B:
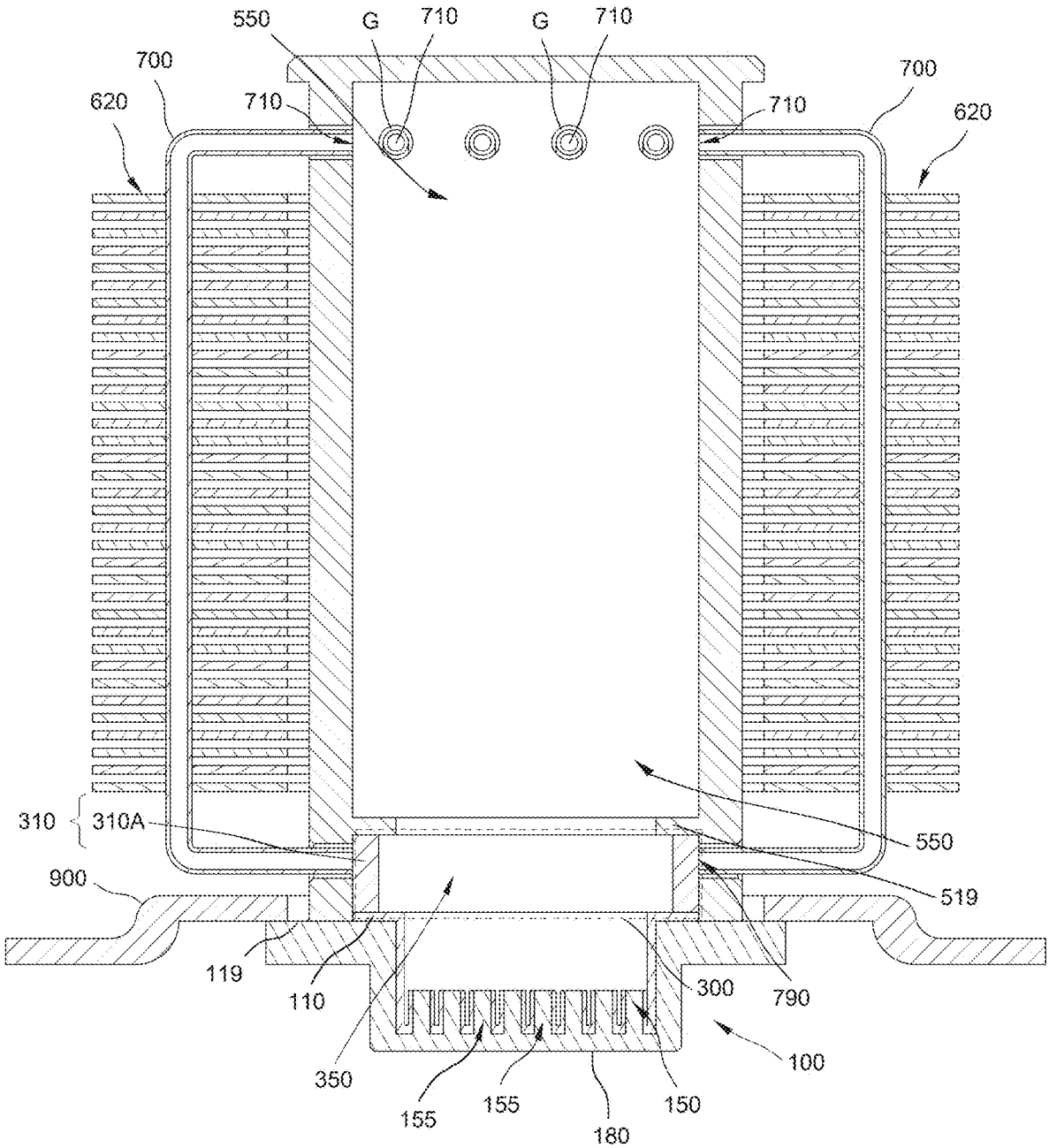
FIG. 2B illustrates a side, cross-sectional view along the B-B' line of the loop thermosiphon assembly of FIG. 2A, in accordance with various embodiments of the present disclosure.

The following describes various principles related to components and assemblies for processor cooling by way of reference to specific examples of loop thermosiphon assemblies, including specific arrangements and examples of thermal interface components and coolant pipes embodying innovative concepts. More particularly, but not exclusively, such innovative principles are described in relation to selected examples of barriers and channels directing vaporized liquid coolant upwards and away from thermal interface components and directing liquefied vapor coolant downwards and toward thermal interface components, and well-known functions or constructions are not described in detail for purposes of succinctness and clarity. Nonetheless, one or more of the disclosed principles can be incorporated in various other embodiments of different barriers and channels directing vaporized liquid coolant upwards and away from thermal interface components and directing liquefied vapor coolant downwards and toward thermal interface components to achieve any of a variety of desired outcomes, characteristics, and/or performance criteria.

Thus, thermal interface components and coolant pipes having attributes that are different from those specific examples discussed herein can embody one or more of the innovative principles, and can be used in applications not described herein in detail. Accordingly, embodiments of barriers and channels not described herein in detail also fall within the scope of this disclosure, as will be appreciated by those of ordinary skill in the relevant art following a review of this disclosure.

Example embodiments as disclosed herein are directed to loop thermosiphon assemblies that can be used in cooling systems to dissipate high heat loads. The loop thermosiphons can be used to cool electronic components such as high-performance processors used in data center servers or other types of electronic components that generate high heat loads during use. The processor can include central processing units (CPUs), graphics processing units (GPUs), neural network processing units (NPUs), tensor processing units (TPUs) etc.

FIGS. 1A to 2B illustrate a loop thermosiphon assembly 10, in accordance with various embodiments of the present disclosure. The loop thermosiphon assembly 10 includes a thermal interface component 100, a channel 300, a first vapor channel 550, and one or more coolant pipes 700. The thermal interface component 100 includes a liquid coolant and is configured to be coupled to a heat source (not shown) to be cooled. The liquid coolant may include water, inhibited glycol and water solutions, dielectric fluids, custom heat transfer fluids, antifreeze, and the like. The channel 300 includes a vapor barrier 310 and a second vapor channel 350 and is coupled to the thermal interface component 100. The first vapor channel 550 is coupled to the channel 300 and the one or more coolant pipes 700 is coupled to the first vapor channel 550. The first vapor channel 550 is in communication with the thermal interface component 100 via the second vapor channel 350. Each of the one or more coolant pipes 700 has an input end 710 and an output end 790. The one or more coolant pipes 700 includes a pipe formed with a metal. For example, the material forming each of the one or more coolant pipes 700 can include high thermally conductive metals, such as aluminum, copper, and alloys thereof. The input end 710 of the one or more coolant pipes 700 is in communication with the second vapor channel 350 via the first vapor channel 550. The vapor barrier 310 is coupled to the output end 790 of the one or more coolant pipes 700. The thermal interface component 100 is in communication with the output end 790 of the one or more coolant pipes 700 via the vapor barrier 310. The second vapor channel 350 and the first vapor channel 550 direct vaporized liquid coolant upwards and away from the thermal interface component 100 and the heat source, and the one or more coolant pipes 700 and the vapor barrier 310 direct liquefied vapor coolant downwards and toward the thermal interface component 100 and the heat source.

In some embodiments, the thermal interface component 100 includes a flat interface surface 190 and a heat exchange chamber 150. The heat exchange chamber 150 is opposite the flat interface surface 190. The flat interface surface 190 is in thermal communication with the heat source. In some embodiments, the heat source is a processor. For example, the processor can include a central processing unit, a graphics processing unit, a neural network processing unit, and a tensor processing unit.

In some embodiments, the thermal interface component 100 includes a cold plate formed with a metal. In some embodiments, the thermal interface component 100 includes a block formed with a metal. For example, the material forming the thermal interface component 100 can include high thermally conductive metals, such as aluminum, copper, and alloys thereof.

In some embodiments, the loop thermosiphon assembly 10 includes a mounting bracket 900 configured to mount the flat interface surface 190 of the thermal interface component 100 to a processor or a heat spreader of the processor via fasteners. In some embodiments, the thermal interface component 100 includes a top ledge 119 and the mounting bracket 900 includes an opening. The mounting bracket 900 is coupled to the top ledge 119 and surrounds the channel 300.

In some embodiments, the loop thermosiphon assembly 10 includes a thermal interface material (not shown) between the flat interface surface 190 and processor or between the flat interface surface 190 and heat spreader so as to enable efficient heat transfer therebetween.

In some embodiments, the heat exchange chamber 150 includes a plurality of heat transfer fins 155. In some embodiments, the plurality of heat transfer fins 155 includes one or more pin fins. The one or more pin fins is substantially perpendicular to the heat source and is configured to enable low thermal resistance. For example, cross-sectional shapes of the one or more pin fins can include circular, ellipse, diamond, square and triangular shapes.

In some embodiments, the loop thermosiphon assembly 10 further includes a heat exchanger 620 coupled to the one or more coolant pipes 700. The heat exchanger 620 includes a plurality of stacked horizontal fins stacked in a tower formation to increase the rate of heat transfer to the environment by increasing convection. Each of the plurality of stacked horizontal fins has a large surface area to dissipate heat while maintaining airflow through the heat exchanger 620. For example, the plurality of stacked horizontal fins are coupled to vertical portions 750 of the one or more coolant pipes 700. Each of the plurality of stacked horizontal fins extends from the vertical portions 750 of the one or more coolant pipes 700. The plurality of stacked horizontal fins are stacked one on top of the other to transfer heat from the one or more coolant pipes 700 at different heights. The heat exchanger 620 dissipates heat from liquified vapor coolant inside of the one or more coolant pipes 700 to air that flows past the plurality of stacked horizontal fins. In some embodiments, a fan or fans (not shown) may be used to blow air past the heat exchanger 620. The heat exchanger 620 can be formed using high thermally conductive metals, such as aluminum, copper, and alloys thereof.

In some embodiments, the one or more coolant pipes 700 includes fourteen one or more coolant pipes 700. In some embodiments, the one or more coolant pipes 700 include one or more portions (or the vertical portions 750) directing the liquefied vapor coolant substantially perpendicular to the thermal interface component 100 and the heat source.

Figure 3:
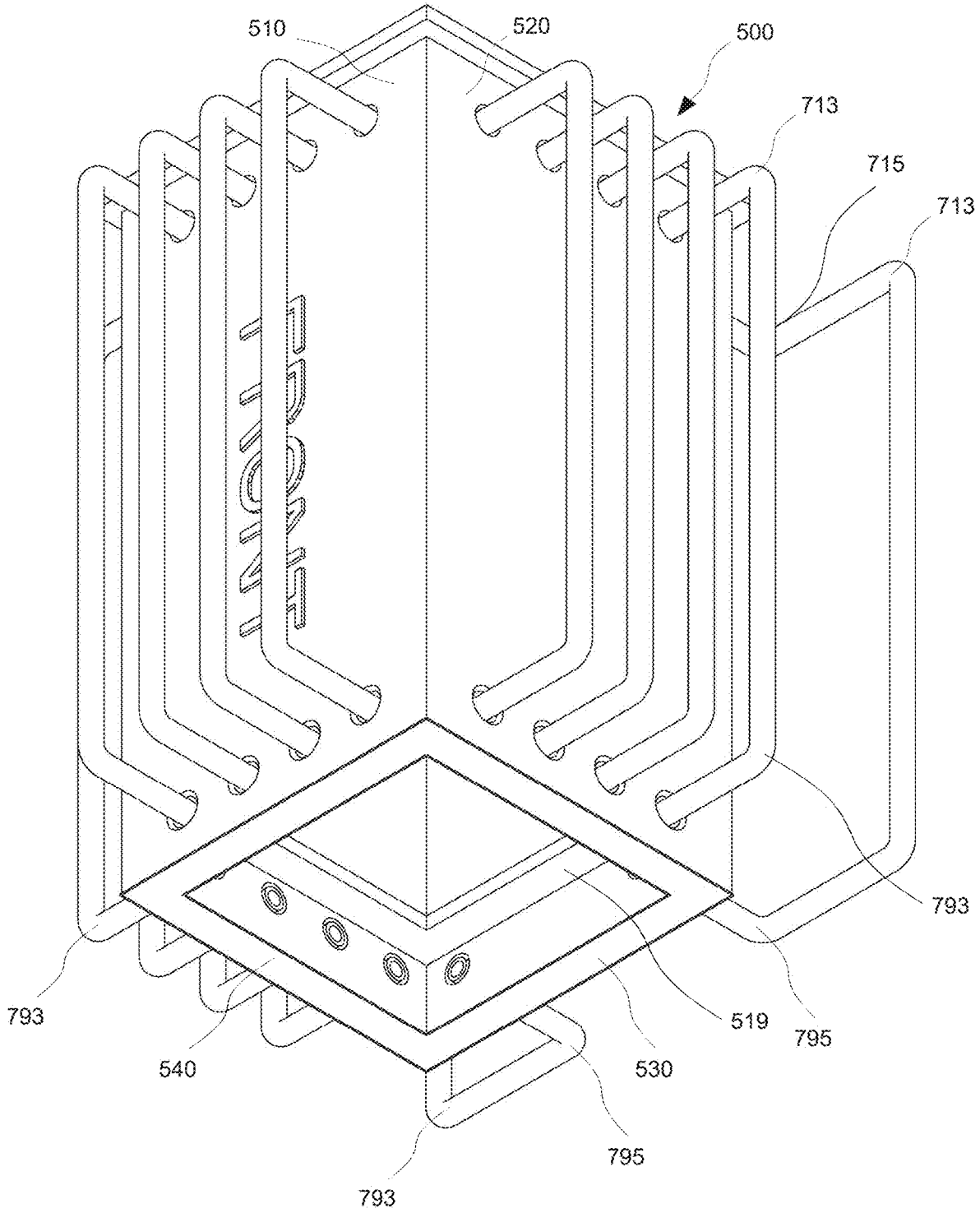
FIG. 3 illustrates a perspective view of a vapor chamber and one or more coolant pipes of the loop thermosiphon assembly of FIG. 1A, in accordance with various embodiments of the present disclosure.

In some embodiments, the first vapor channel 550 and the channel 300 define a vapor chamber 500. FIG. 3 illustrates a perspective view of the vapor chamber 500 and the one or more coolant pipes 700 of the loop thermosiphon assembly 10 of FIG. 1A, in accordance with various embodiments of the present disclosure. The vapor chamber 500 includes a first side 510, a second side 520, a third side 530 and a fourth side 540. The first side 510 is coupled to the second side 520 at a perimeter edge of the first side 510. The first side 510 is coupled to the fourth side 540 at a perimeter edge opposite the perimeter edge coupled to the second side 520. The second side 520 is coupled to the third side 530 at a perimeter edge opposite the perimeter edge coupled to the first side 510. The third side 530 is coupled to the fourth side 540 at a perimeter edge opposite the perimeter edge coupled to the second side 520. The input end 710 and the output end 790 of the one or more coolant pipes 700 are coupled to the first side 510, the second side 520, the third side 530, and the fourth side 540 via respective corresponding through holes of the first side 510, the second side 520, the third side 530, and the fourth side 540.

In some embodiments, the one or more coolant pipes 700 include at least two bent portions 713, 793 extending from opposing ends of each of the vertical portions 750 toward the first side 510, the second side 520, the third side 530 and the fourth side 540 to enable the input end 710 and the output end 790 to be coupled to the first side 510, the second side 520, the third side 530, and the fourth side 540.

In some embodiments, two coolant pipes of the fourteen one or more coolant pipes 700 are coupled to at least one of the first side 510, the second side 520, the third side 530, and the fourth side 540. Each of the two coolant pipes include two bends 715, 795 in a horizontal direction enabling the two coolant pipes to protrude in opposing directions extending beyond planes of opposing perimeter edges of the at least one of the first side 510, the second side 520, the third side 530, and the fourth side 540. For example, two coolant pipes coupled to the third side 530 are bent in two opposite facing directions, forming two opposite facing upside down L shapes from a top perspective view, to enable air that flows past the plurality of stacked horizontal fins in the direction of the first side 510 to the third side 530, to flow past the vertical portions 750 of each of the one or more coolant pipes 700.

In some embodiments, the vapor chamber 500 includes an inner ledge 519 protruding inwardly from the first side 510, the second side 520, the third side 530, and the fourth side 540. A top of the vapor barrier 310 is coupled to a bottom of the inner ledge 519 and a width of the inner ledge 519 is greater than a width of the vapor barrier 310. The inner ledge 519 prevents liquified vapor coolant from the first vapor channel 550 from flowing down to the output end 790 of the one or more coolant pipes 700.

In some embodiments, the vapor chamber 500 is coupled to the thermal interface component 100 via the top ledge 119. In some embodiments, the loop thermosiphon assembly 10 further includes a plurality of gaskets G. For example, the plurality of gaskets G creates a water tight seal between the coupling of the vapor chamber 500 to the top ledge 119 and between the respective couplings of the input end 710 and the output end 790 of the one or more coolant pipes 700 to the first side 510, the second side 520, the third side 530, and the fourth side 540.

Figure 4A:
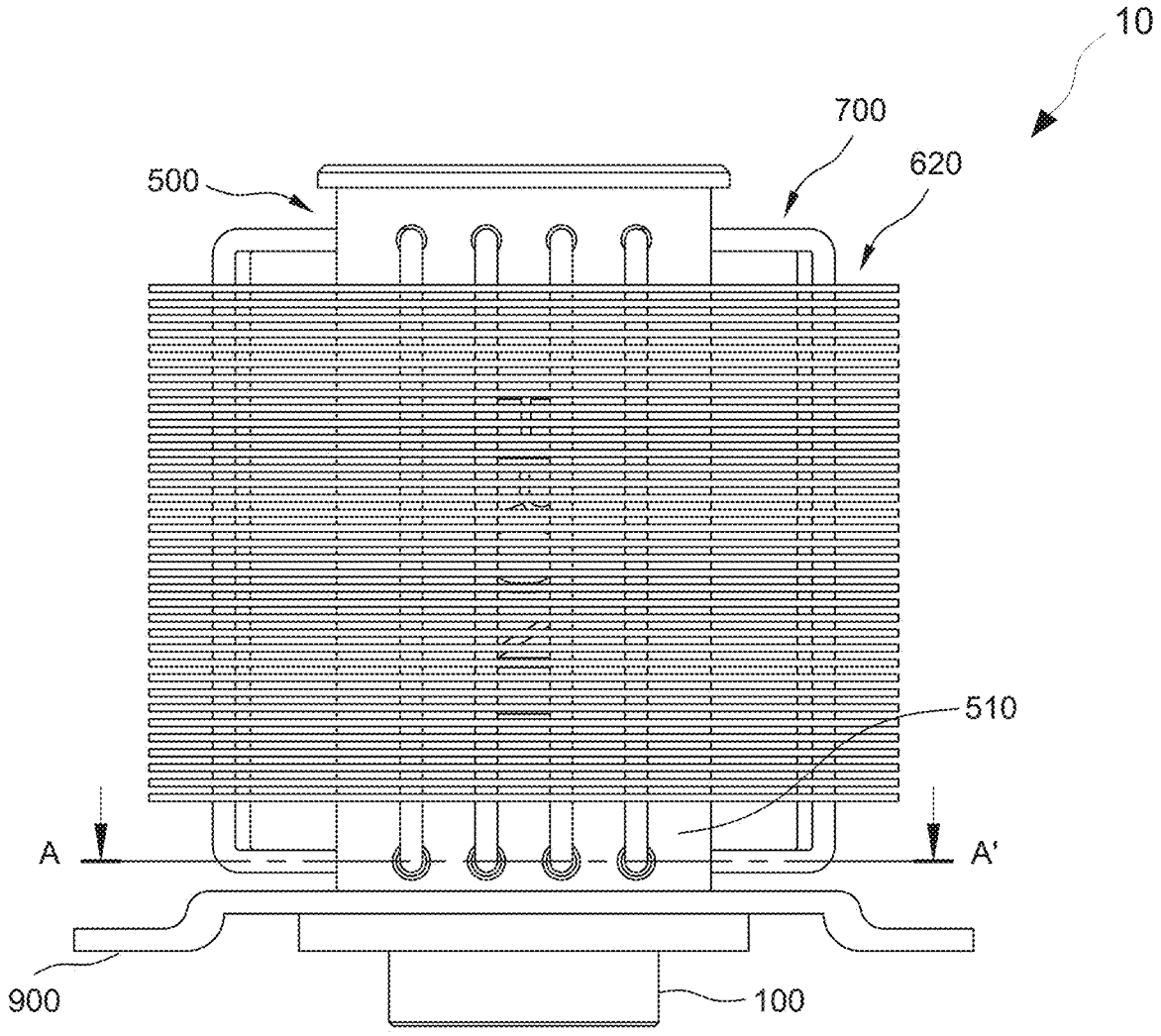
FIG. 4A illustrates a perspective view of the loop thermosiphon assembly of FIG. 1A and a cross-sectional view A-A' line, in accordance with various embodiments of the present disclosure.
Figure 4B:
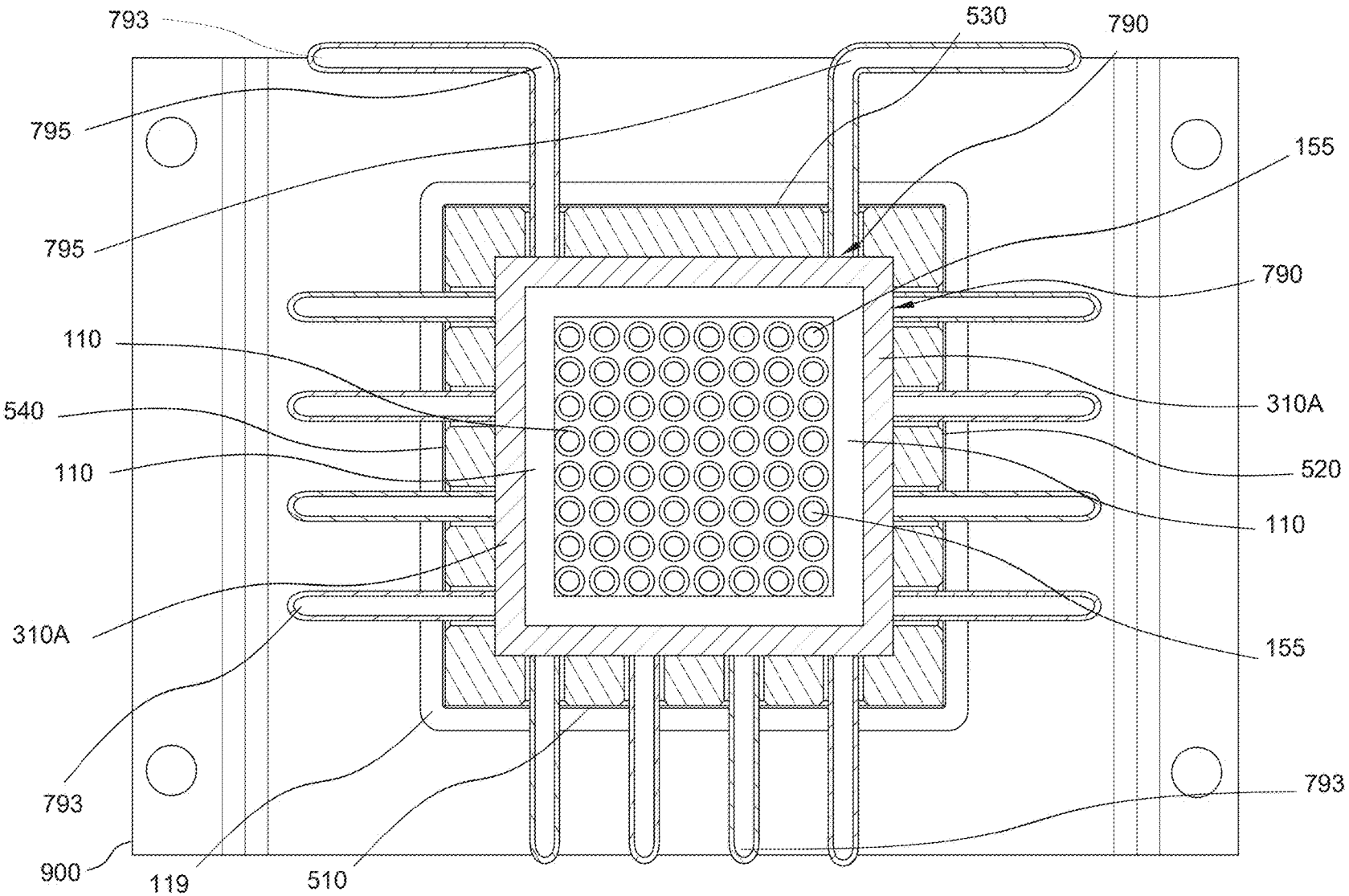
FIG. 4B illustrates a top, cross-sectional view along the A-A' line of the loop thermosiphon assembly of FIG. 4A, in accordance with various embodiments of the present disclosure.

FIGS. 4A and 4B illustrate a cross-sectional view of the loop thermosiphon assembly 10. In some embodiments, the vapor barrier 310 includes a porous lining 310A. The porous lining 310A includes a plurality of pores configured to enable liquified vapor coolant to be directed from the output end 790 to the thermal interface component 100 via the porous lining 310A. In some embodiments, the porous lining 310A includes a metal foam lining. For example, the material forming the foam lining can include high thermally conductive metals, such as aluminum, copper, and alloys thereof.

In some embodiments, the heat exchange chamber 150 includes a capillary wicking layer 110. The capillary wicking layer 110 overlays surfaces of the heat exchange chamber 150 and the plurality of heat transfer fins 155 and is configured to lower thermal resistances and increase the ability to handle higher heat flux. The capillary wicking layer 110 includes a plurality of capillary pores. In some embodiments, the capillary wicking layer 110 can be formed using 3D printing, electrodeposition processes, sintering processes or any other suitable process where the pore sizes of the capillary wicking layer 110 can be controlled. In some embodiments, the capillary wicking layer 110 includes a sintered metal wick structure. For example, the material forming the sintered metal wick structure can include high thermally conductive metals, such as aluminum, copper, and alloys thereof.

In some embodiments, the porous lining 310A is coupled to the capillary wicking layer 110, allowing liquified vapor coolant to flow through the plurality of pores of the porous lining 310A to the plurality of capillary pores of the capillary wicking layer 110. In some embodiments, the plurality of capillary pores has a smaller pore size than the plurality of pores to enable a higher capillary pressure within the plurality of capillary pores, thus preventing liquified vapor coolant from travelling back into the plurality of pores and preventing liquid coolant from travelling into the plurality of pores.

Figure 5:
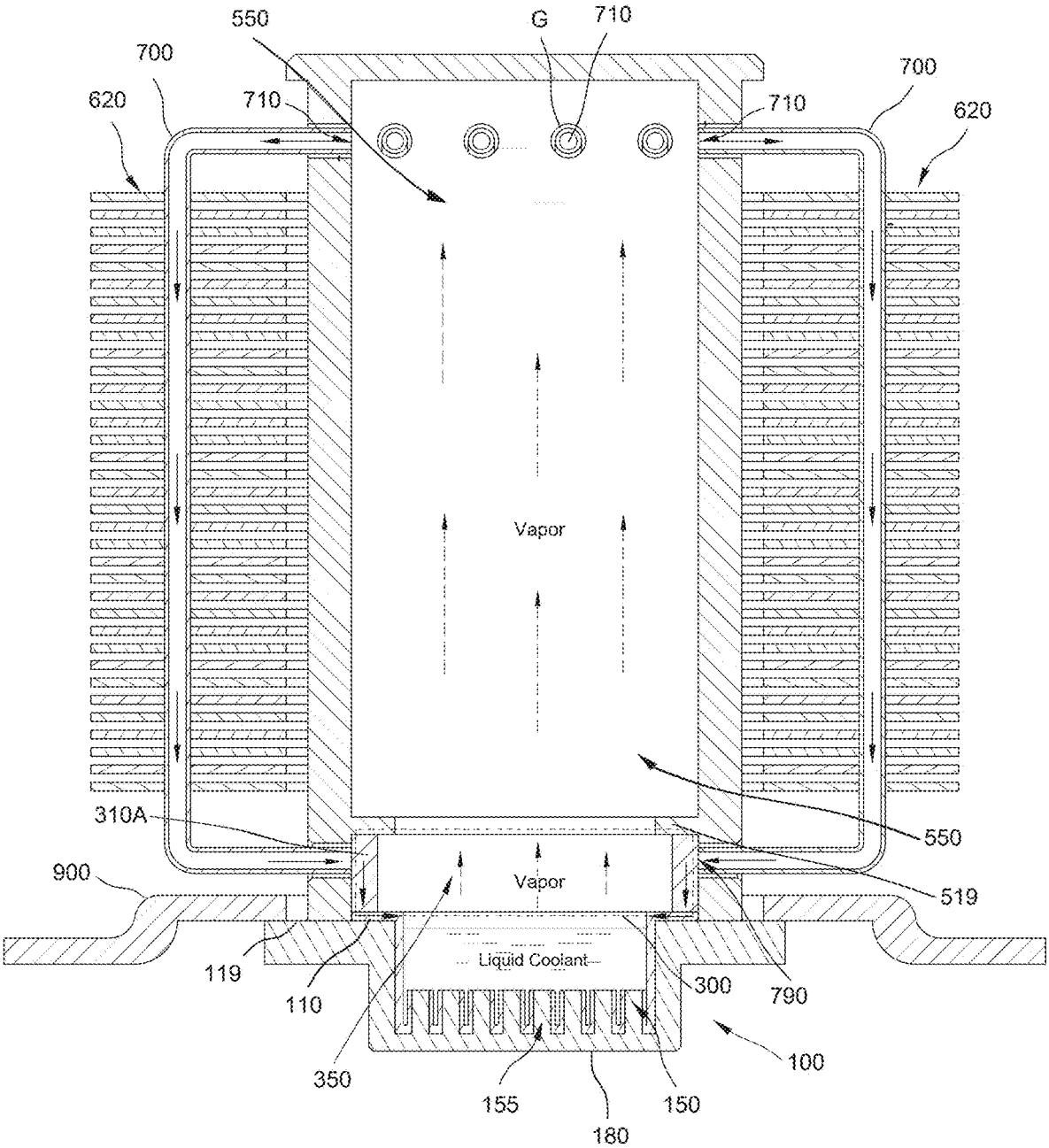
FIG. 5 illustrates the side, cross-sectional view along the B-B' line of the loop thermosiphon assembly of FIG. 2A and liquid coolant flow, in accordance with various embodiments of the present disclosure.
Figure 6:
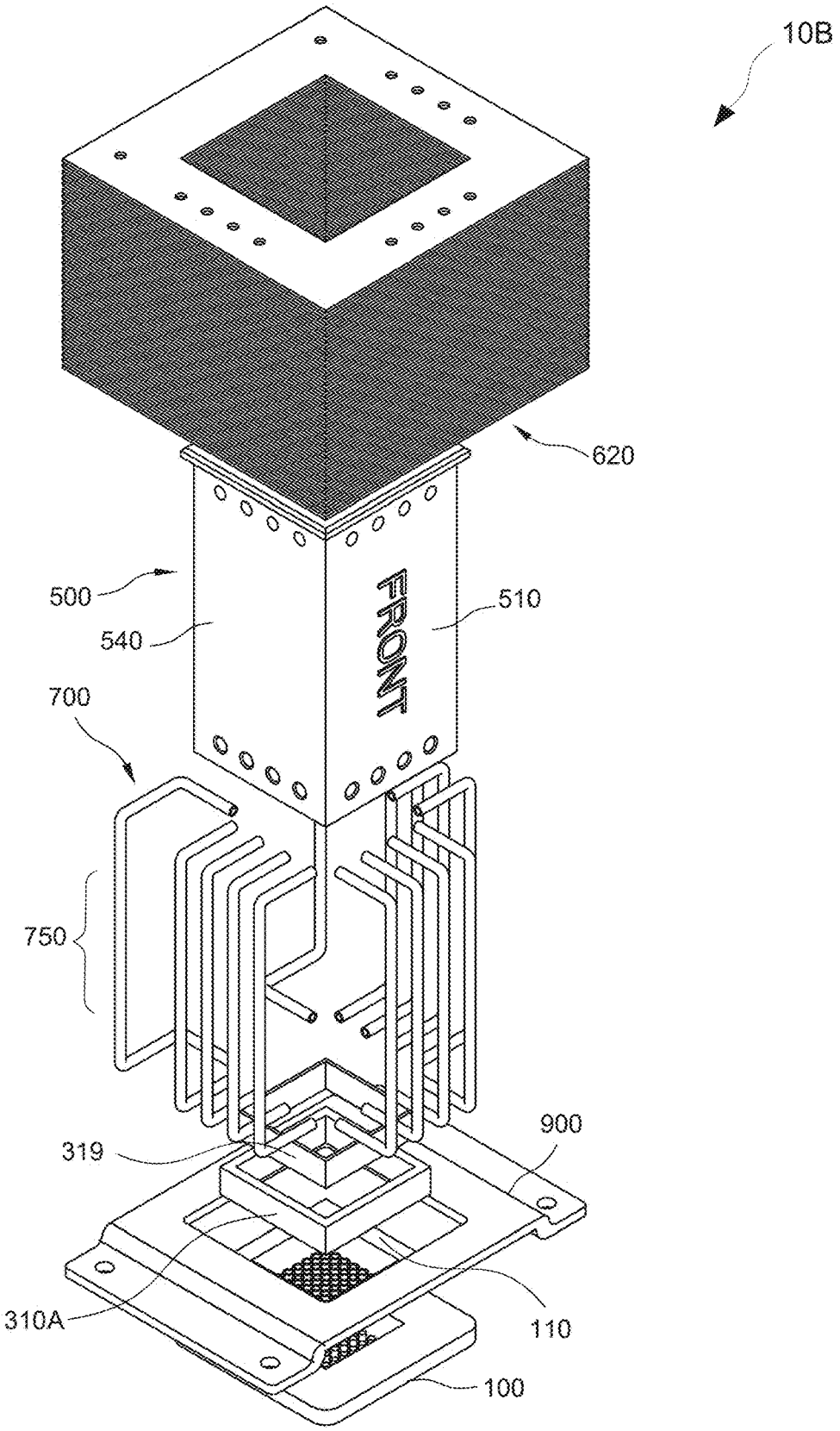
FIG. 6 illustrates an exploded view of another loop thermosiphon assembly, in accordance with various embodiments of the present disclosure.
Figure 7A:
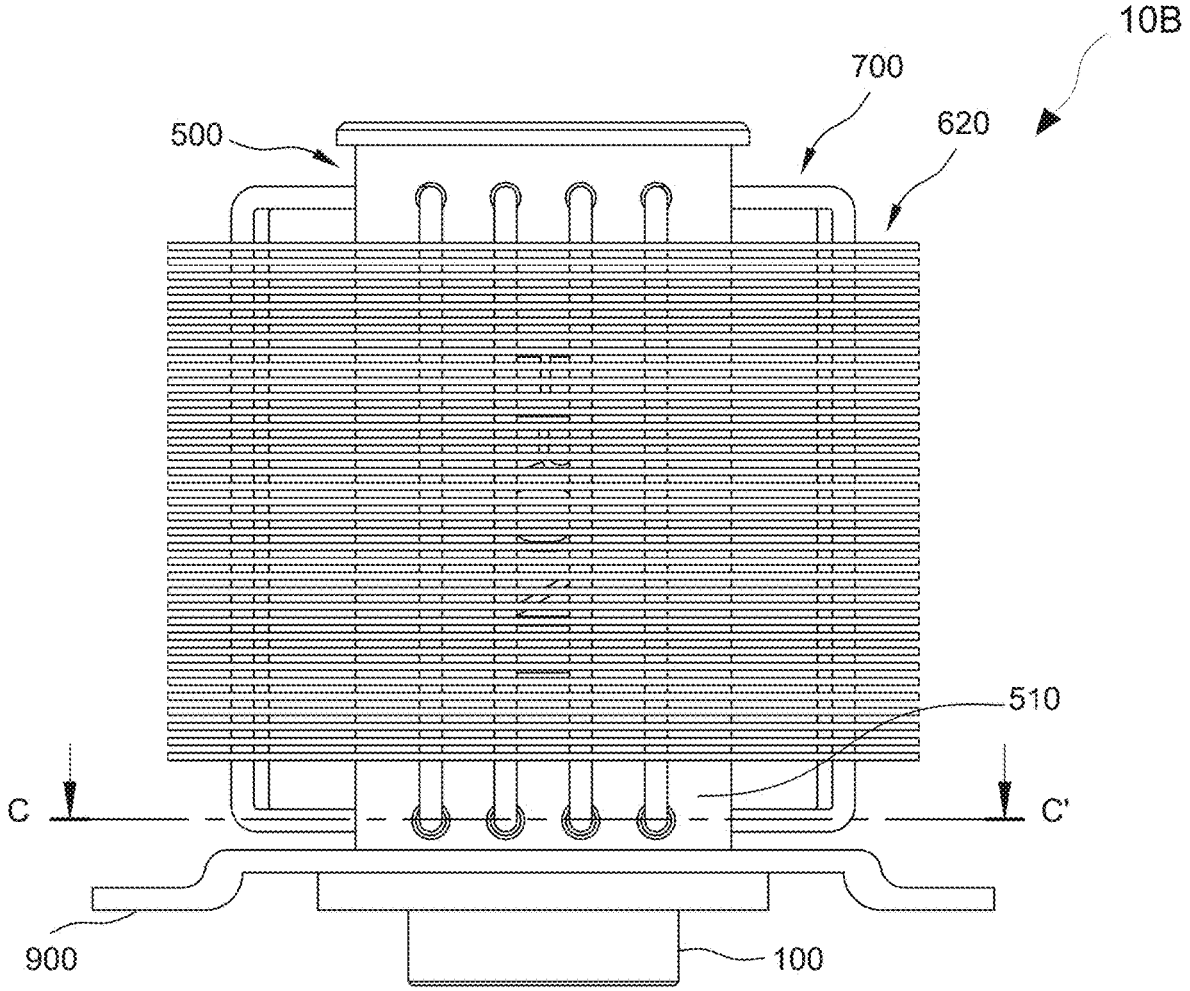
FIG. 7A illustrates a perspective view of the another I loop thermosiphon assembly of FIG. 6 and a cross-sectional view C-C' line, in accordance with various embodiments of the present disclosure.
Figure 7B:
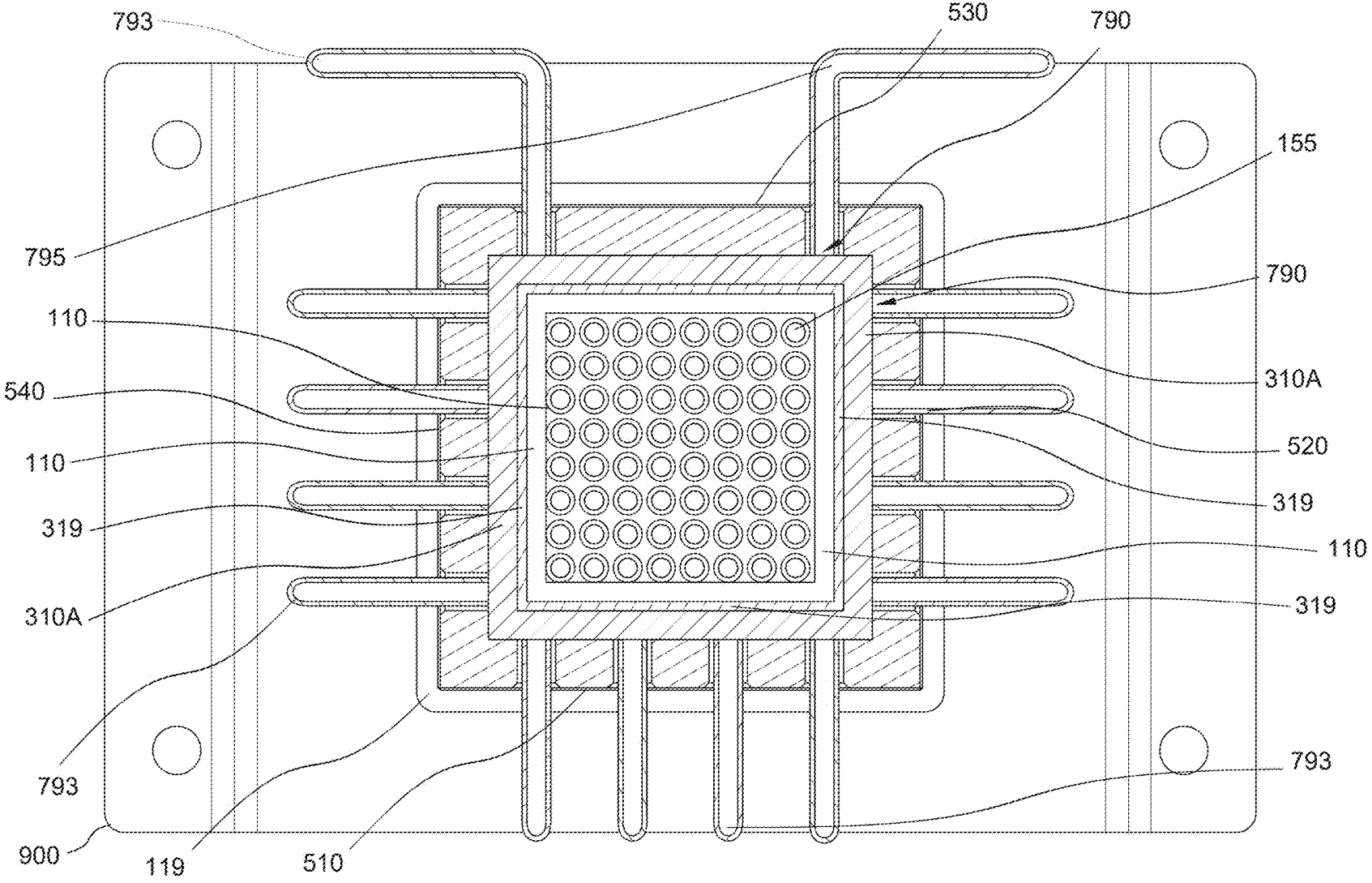
FIG. 7B illustrates a top, cross-sectional view along the C-C' line of the another loop thermosiphon assembly of FIG. 7A, in accordance with various embodiments of the present disclosure.
Figure 8A:
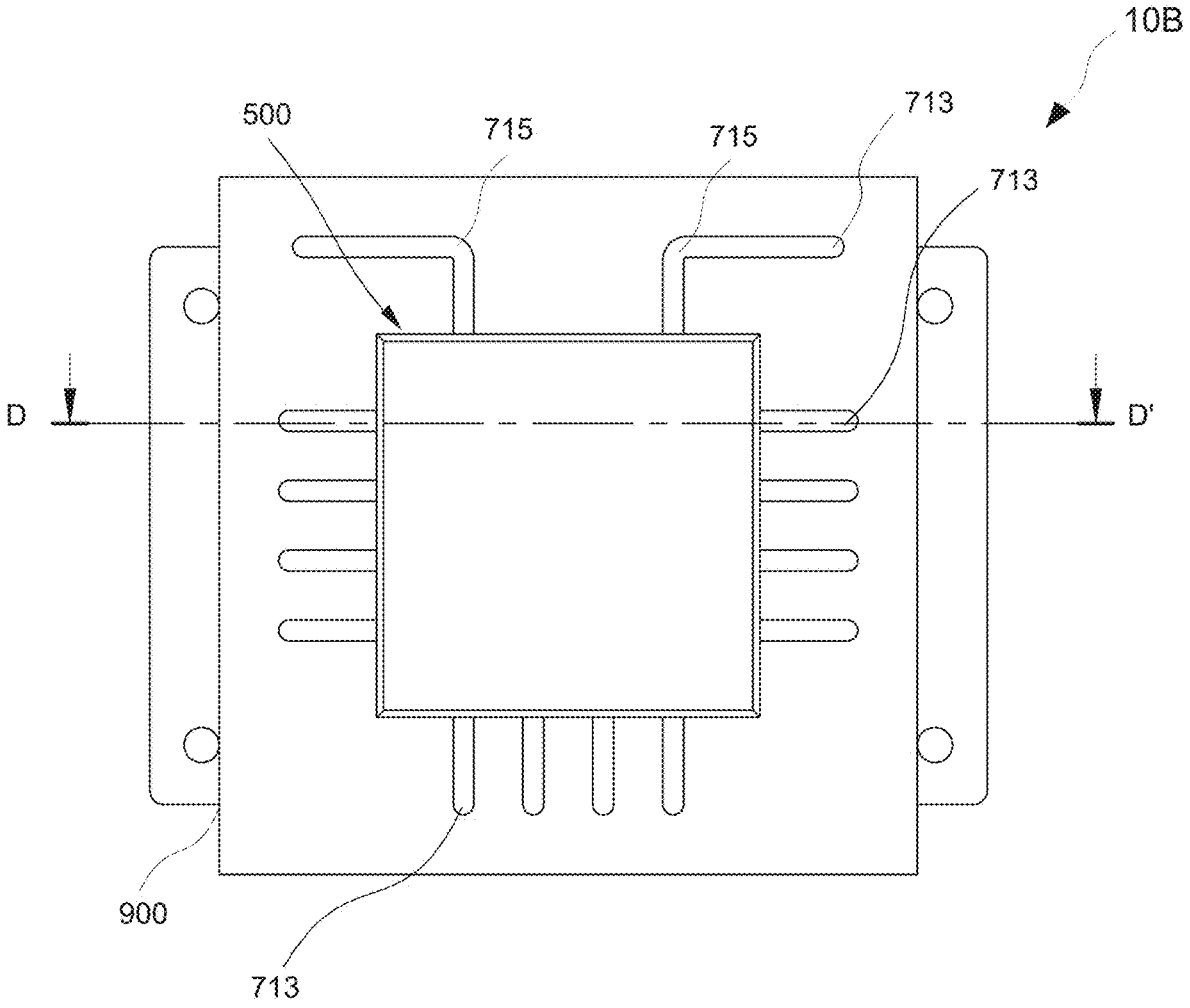
FIG. 8A illustrates a perspective view of the another loop thermosiphon assembly of FIG. 6 and a cross-sectional view D-D' line, in accordance with various embodiments of the present disclosure.
Figure 8B:
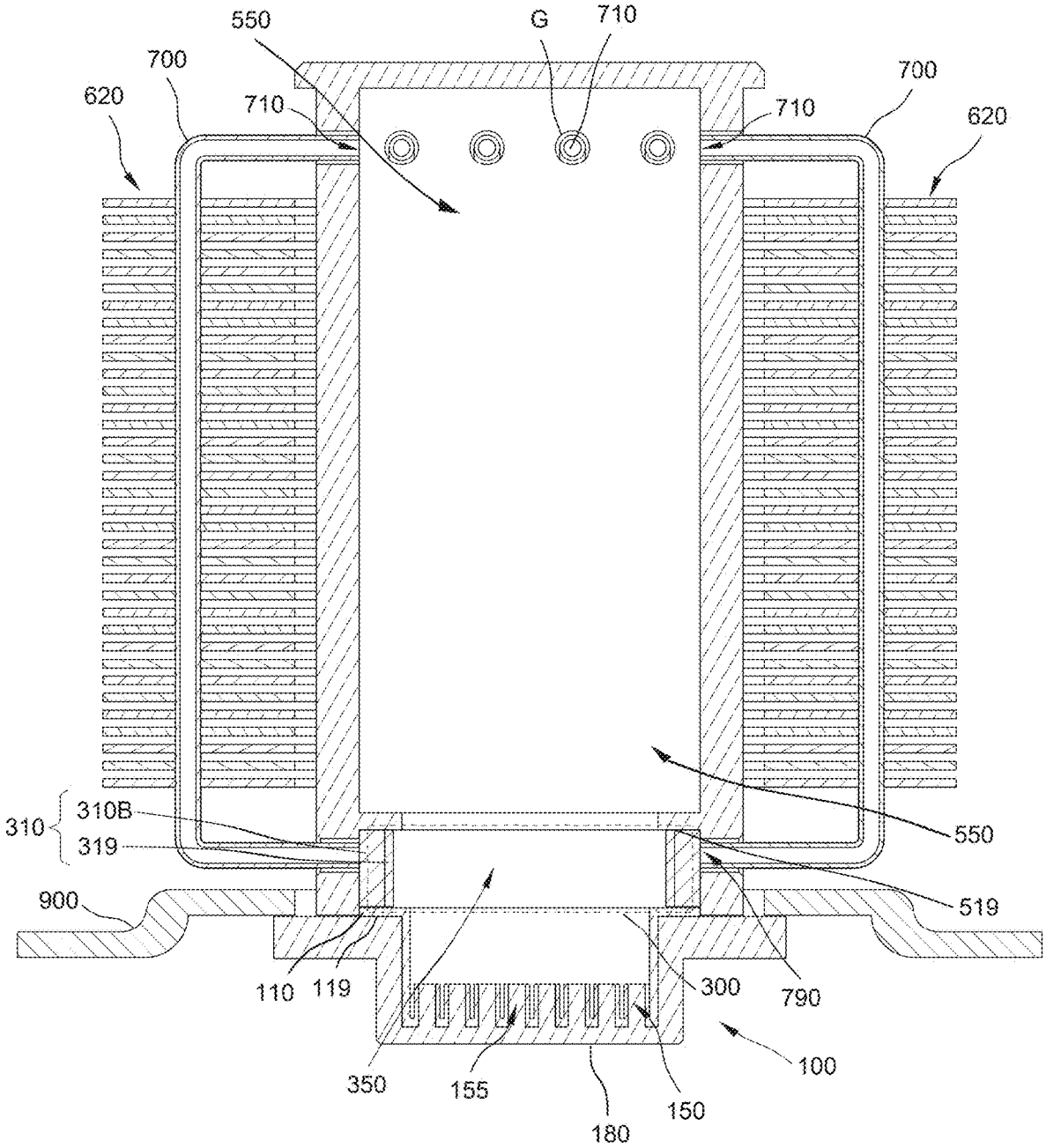
FIG. 8B illustrates a side, cross-sectional view along the D-D' line of the another loop thermosiphon assembly of FIG. 8A, in accordance with various embodiments of the present disclosure.
Figure 9:
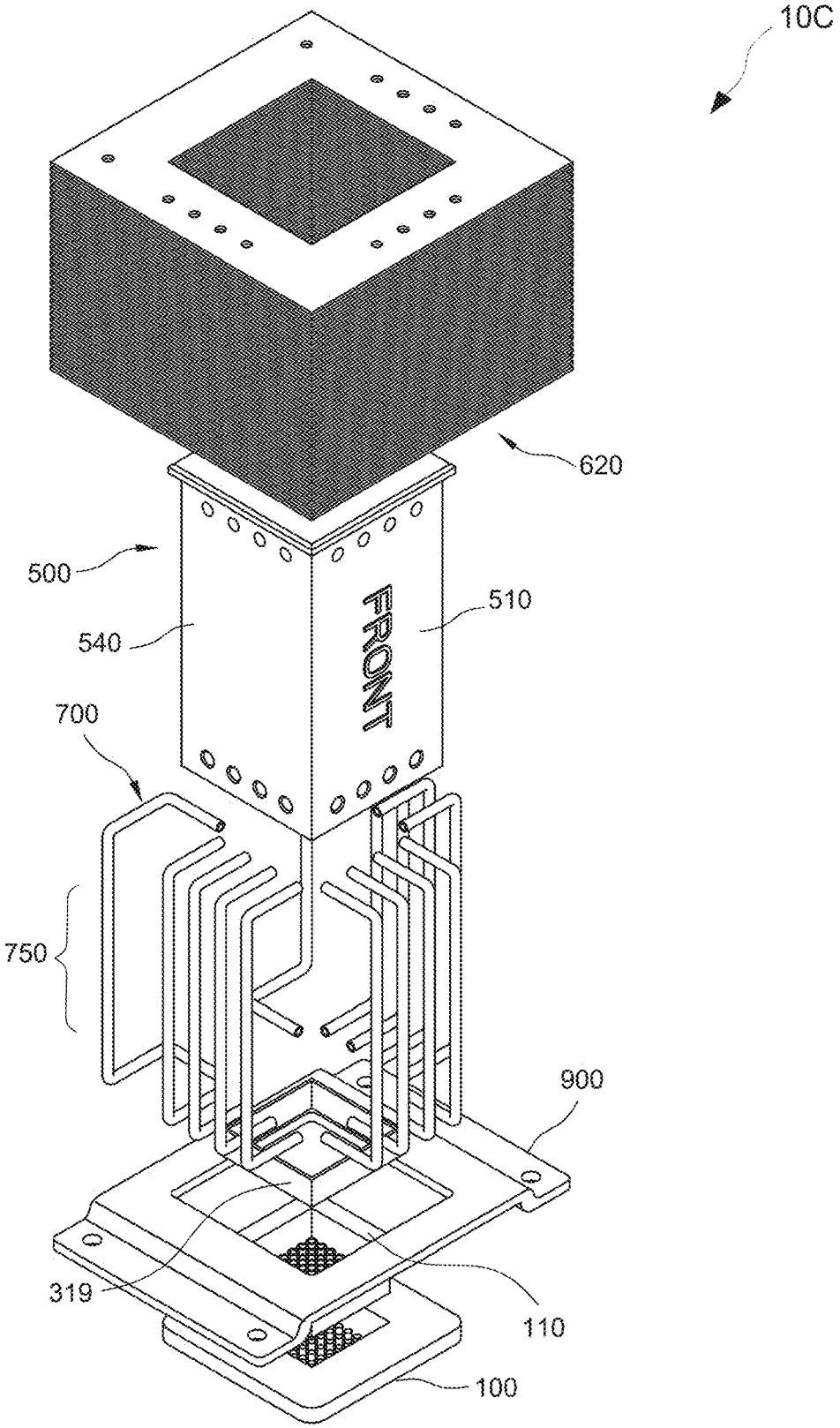
FIG. 9 illustrates an exploded view of yet another loop thermosiphon assembly, in accordance with various embodiments of the present disclosure.
Figure 10A:
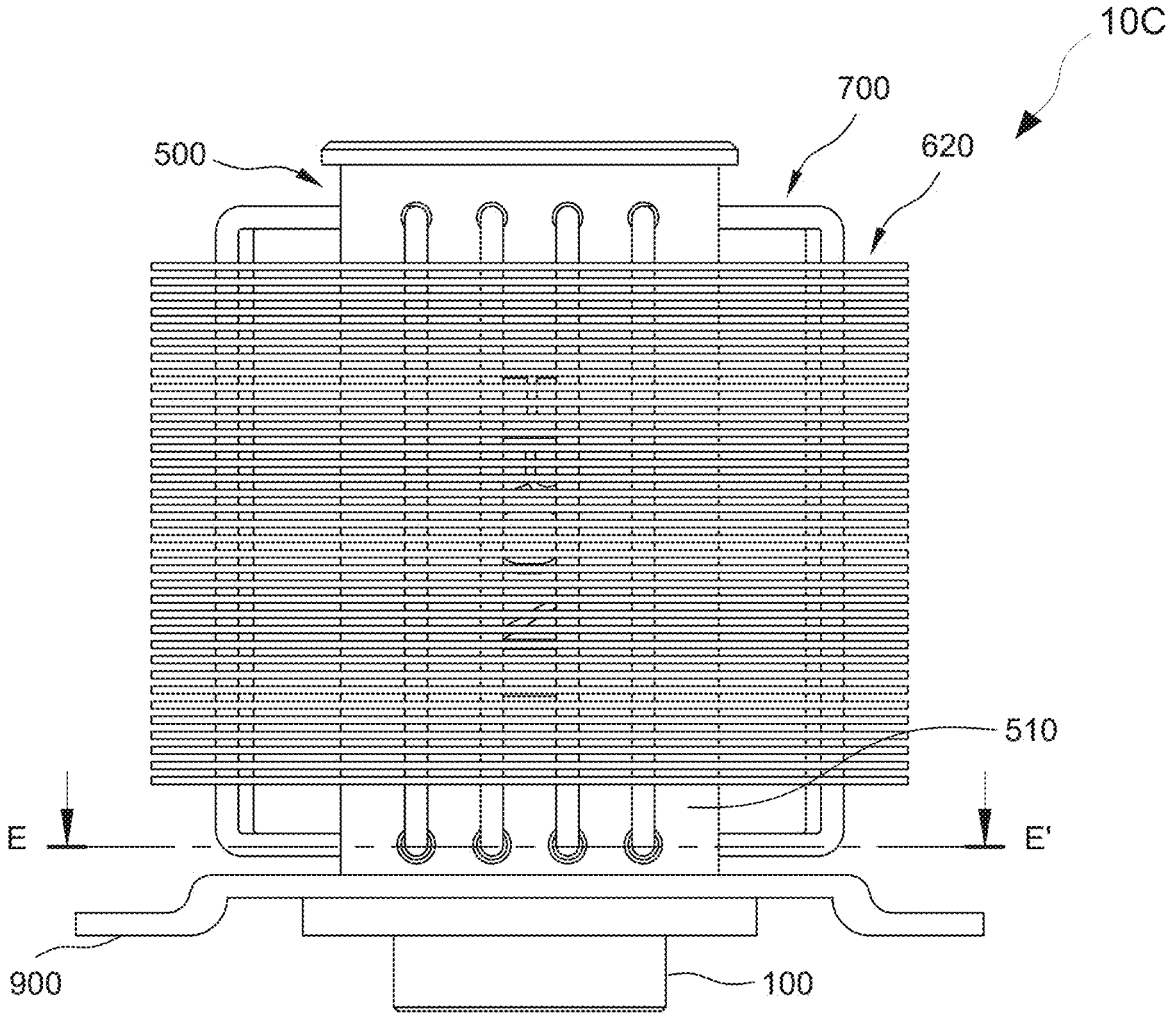
FIG. 10A illustrates a perspective view of the yet another loop thermosiphon assembly of FIG. 9 and a cross-sectional view E-E' line, in accordance with various embodiments of the present disclosure.
Figure 10B:
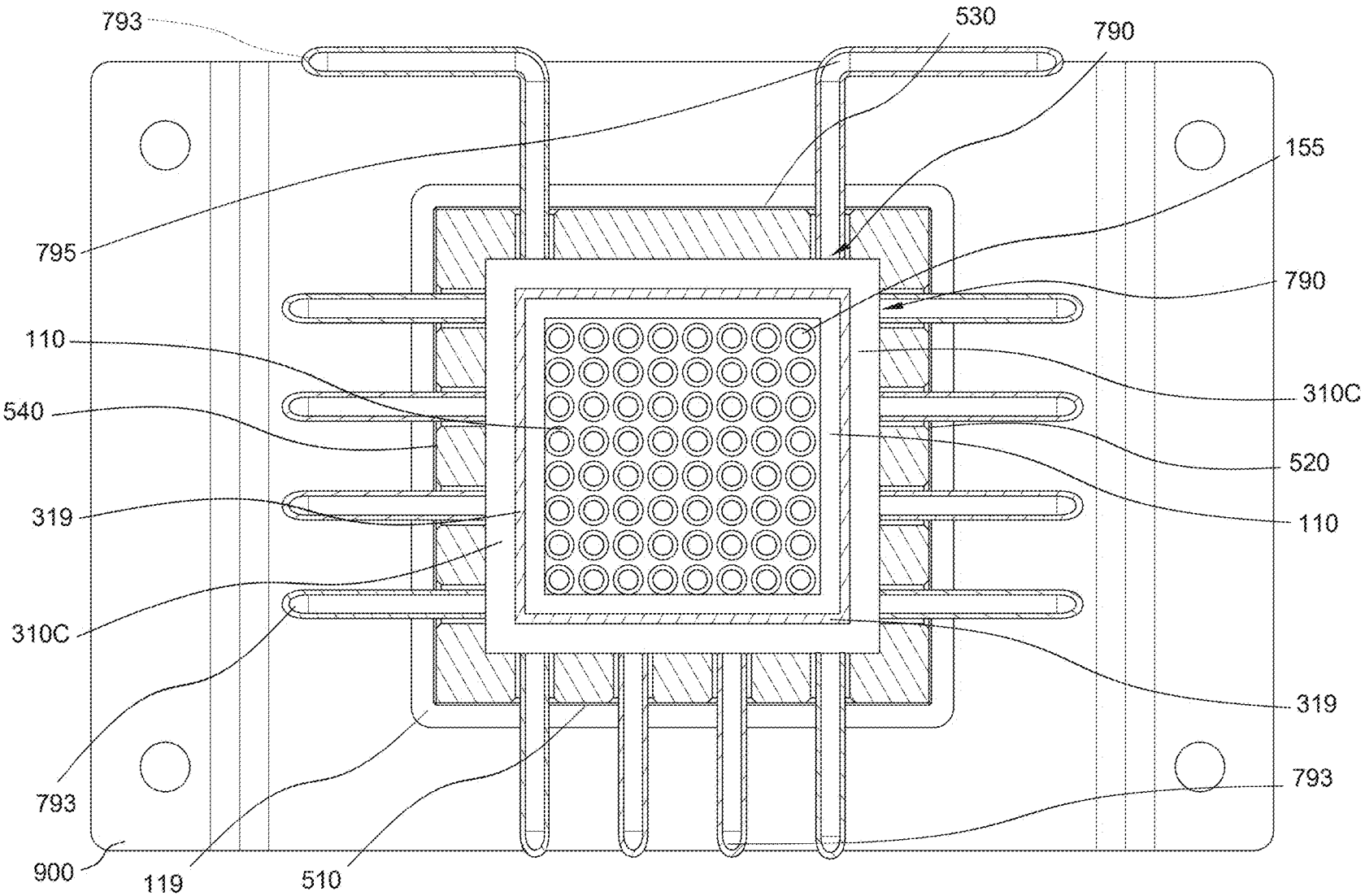
FIG. 10B illustrates a top, cross-sectional view along the E-E' line of the yet another loop thermosiphon assembly of FIG. 10A, in accordance with various embodiments of the present disclosure.
Figure 11A:
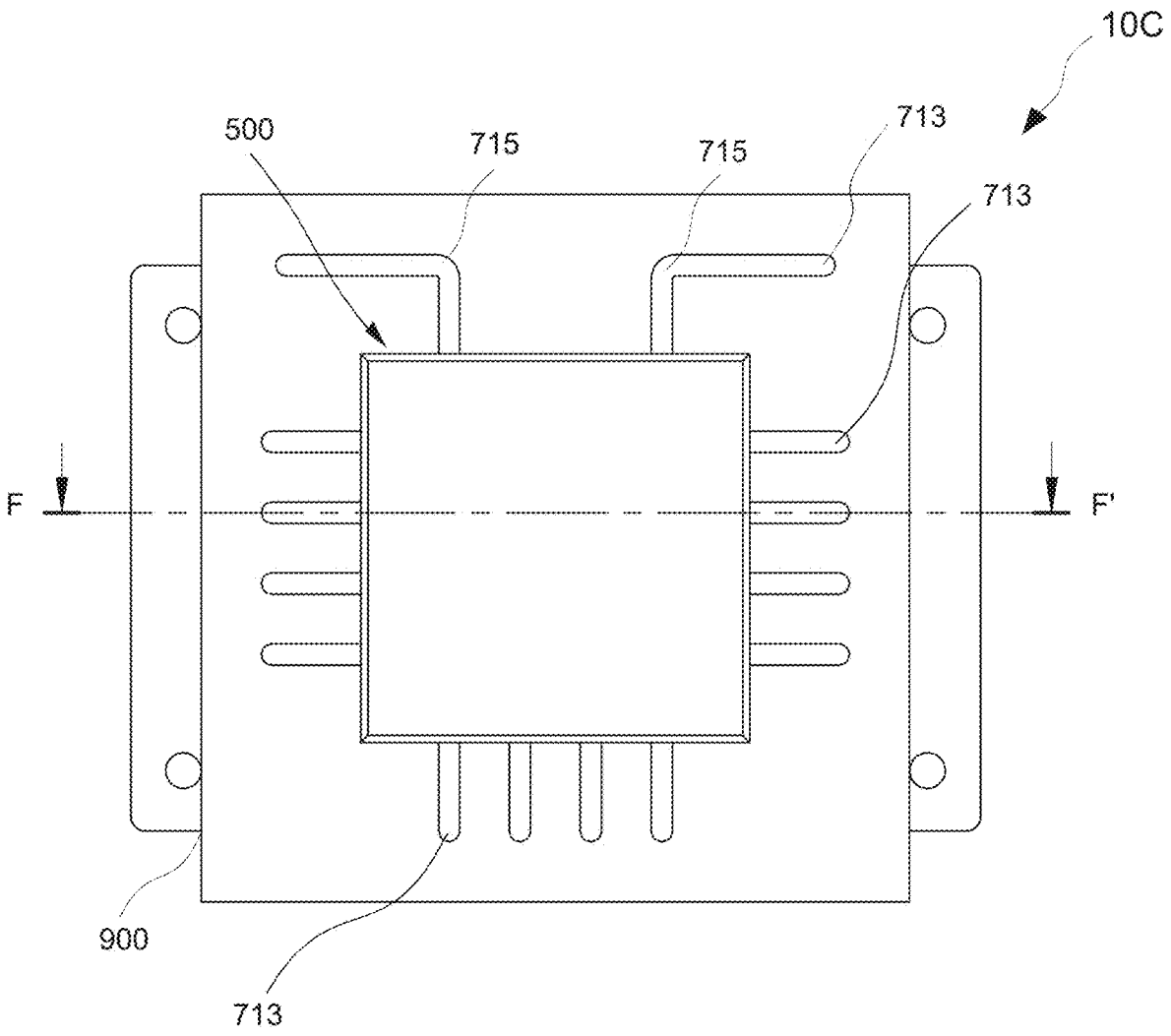
FIG. 11A illustrates a perspective view of the yet another loop thermosiphon assembly of FIG. 9 and a cross-sectional view F-F' line, in accordance with various embodiments of the present disclosure.
Figure 11B:
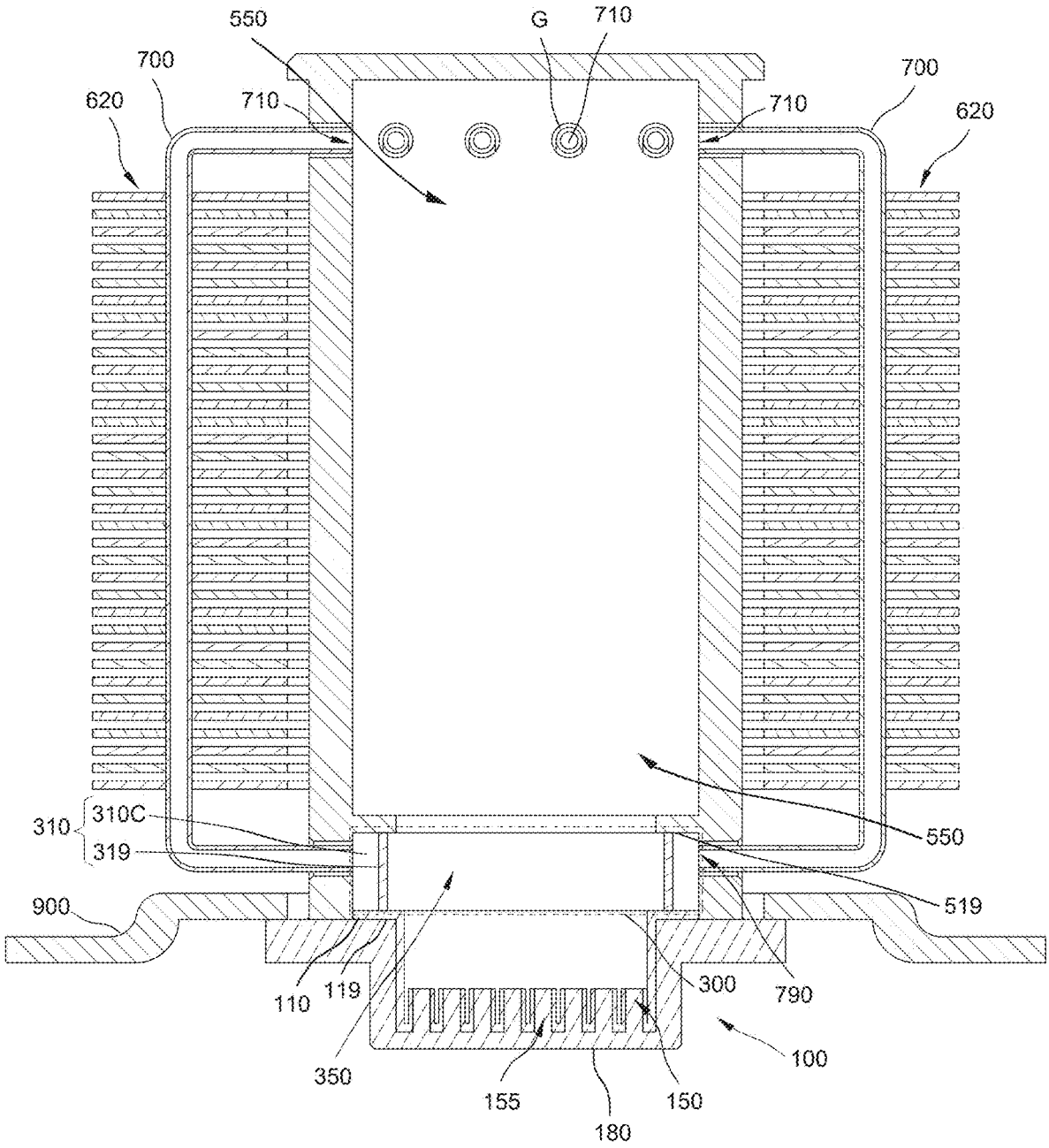
FIG. 11B illustrates a side, cross-sectional view along the F-F' line of the yet another loop thermosiphon assembly of FIG. 11A, in accordance with various embodiments of the present disclosure.
Figure 12:
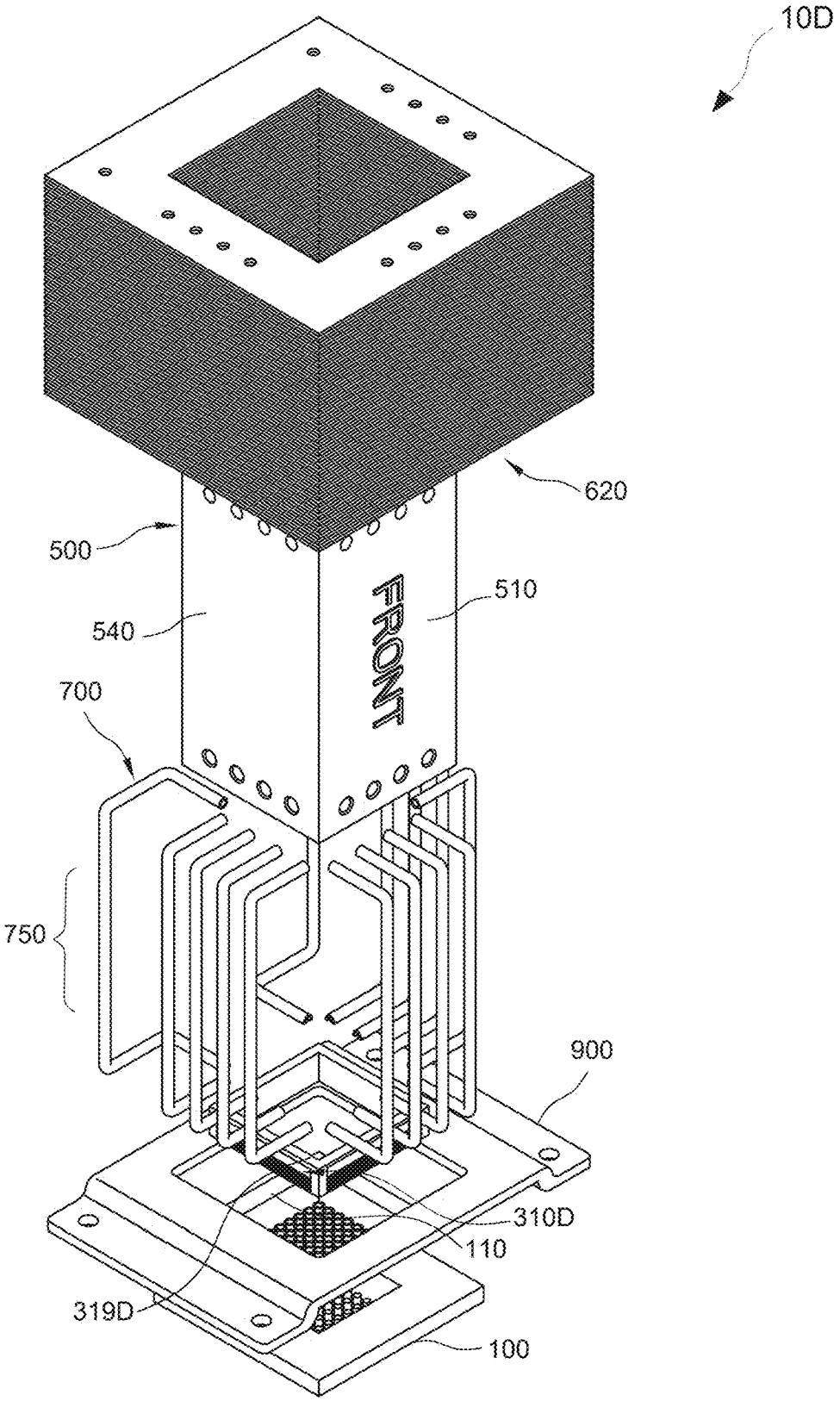
FIG. 12 illustrates an exploded view of further yet another loop thermosiphon assembly, in accordance with various embodiments of the present disclosure.
Figure 13:
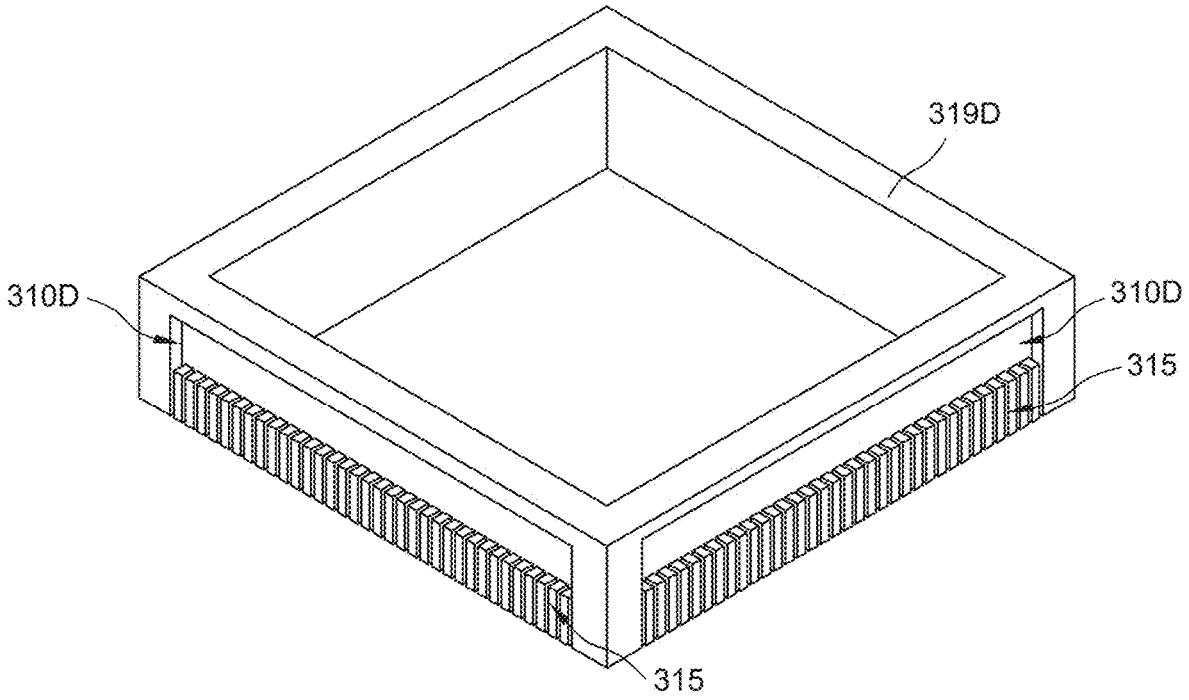
FIG. 13 illustrates a vapor barrier of the further yet another loop thermosiphon assembly of FIG. 12, in accordance with various embodiments of the present disclosure.
Figure 14:
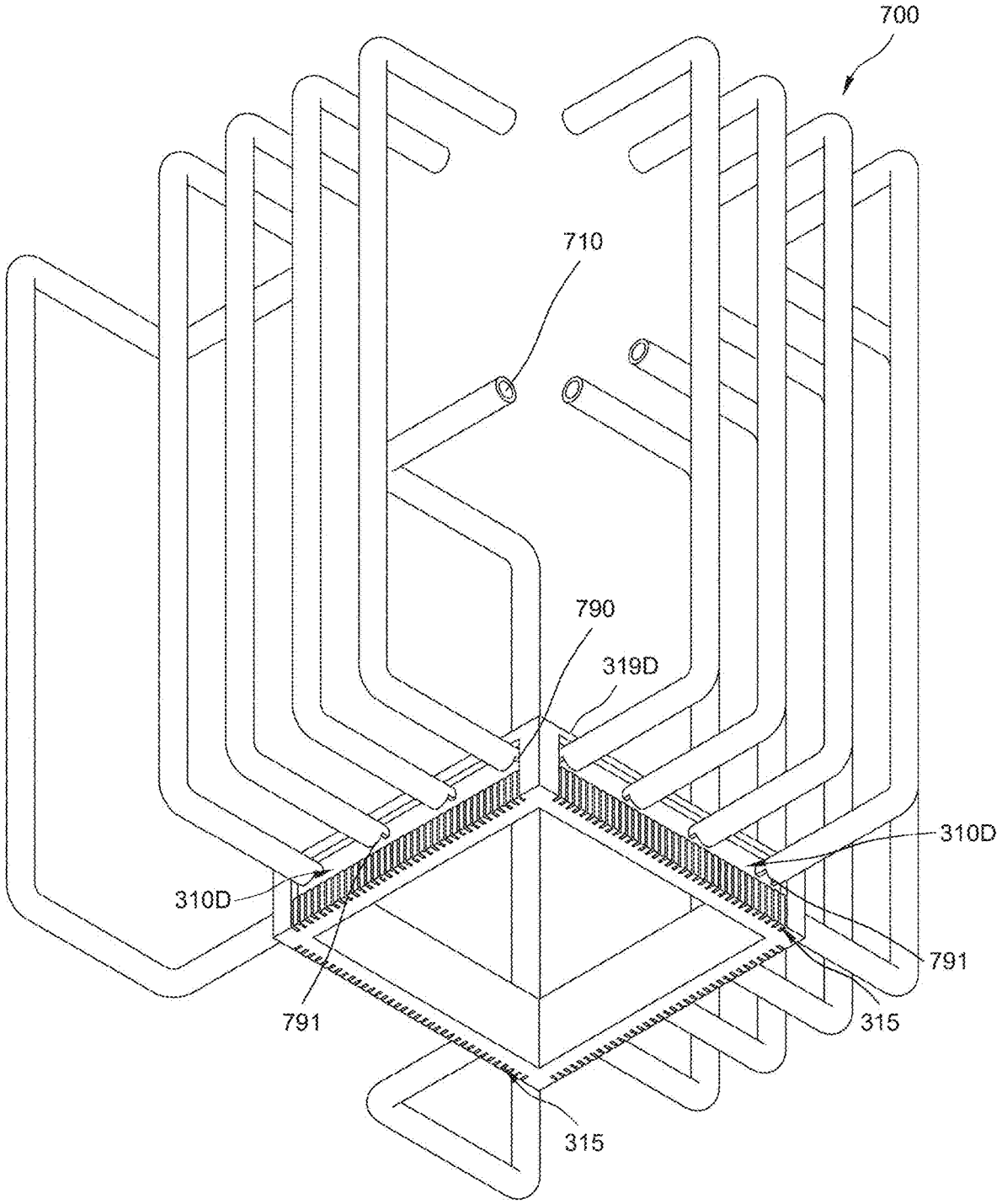
FIG. 14 illustrates one or more coolant pipes and the vapor barrier of the further yet another loop thermosiphon assembly of FIG. 12, in accordance with various embodiments of the present disclosure.
Figure 15A:
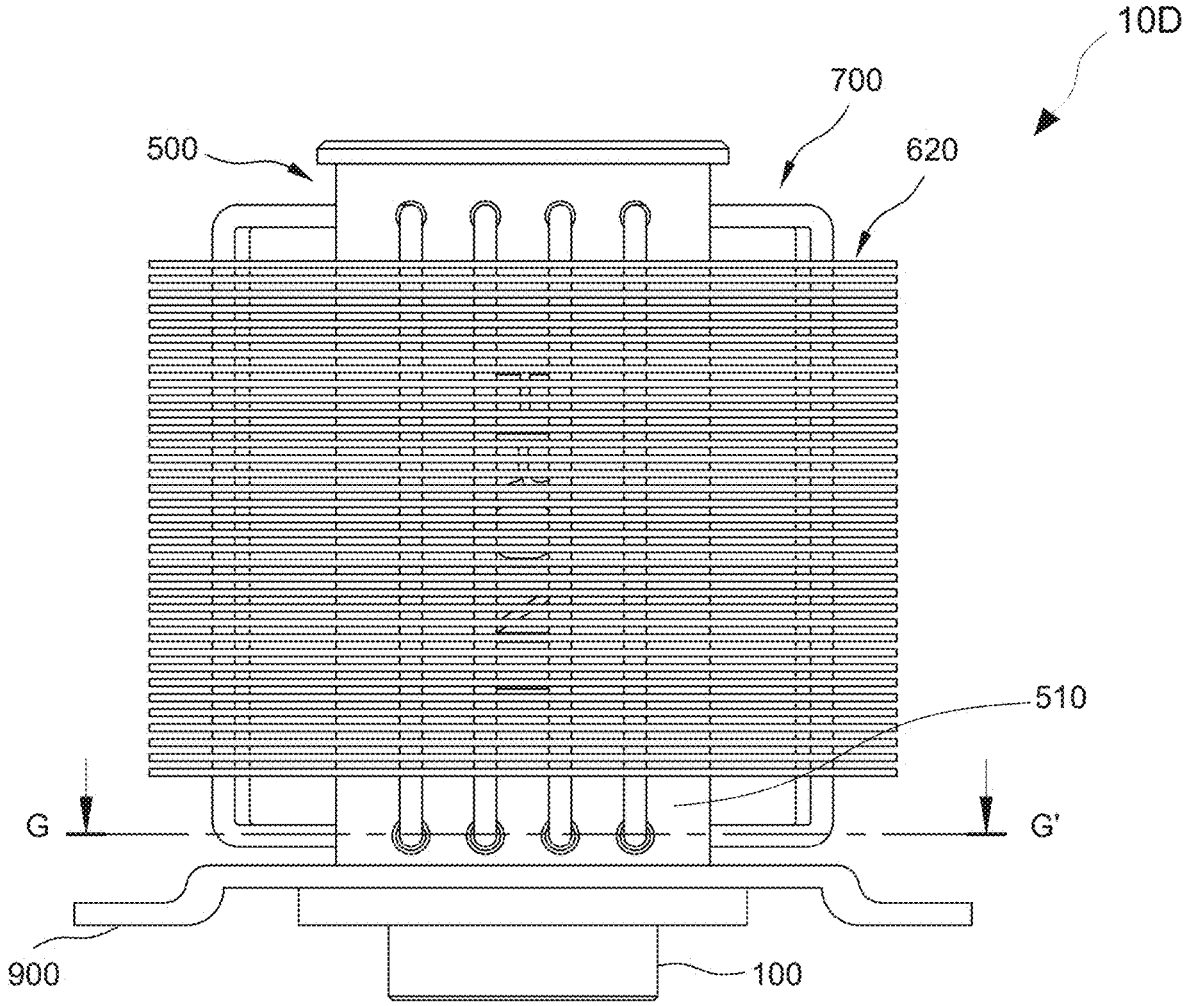
FIG. 15A illustrates a perspective view of the further yet another loop thermosiphon assembly of FIG. 12 and a cross-sectional view G-G' line, in accordance with various embodiments of the present disclosure.
Figure 15B:
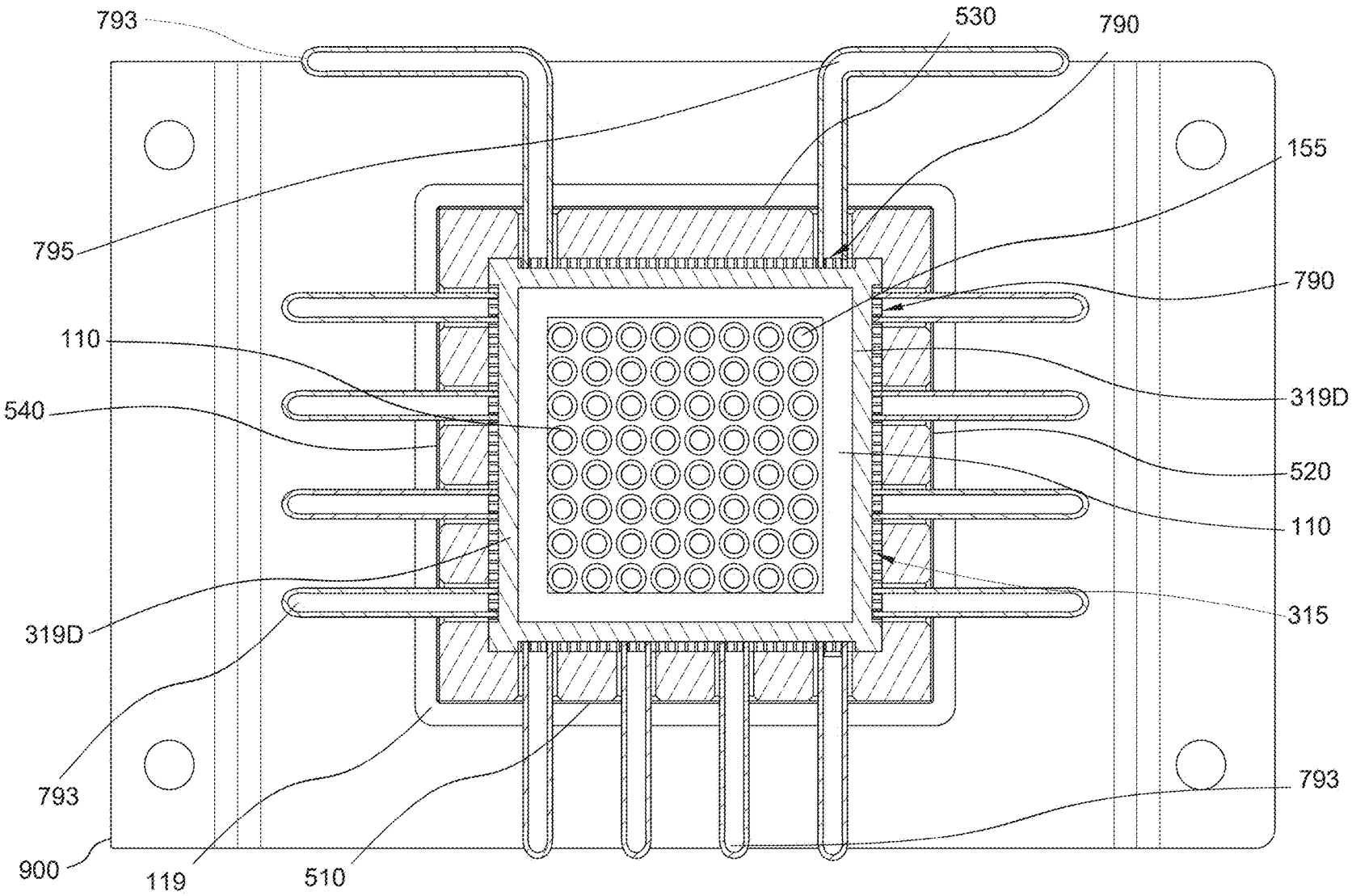
FIG. 15B illustrates a top, cross-sectional view along the G-G' line of the further yet another loop thermosiphon assembly of FIG. 15A, in accordance with various embodiments of the present disclosure.
Figure 16A:
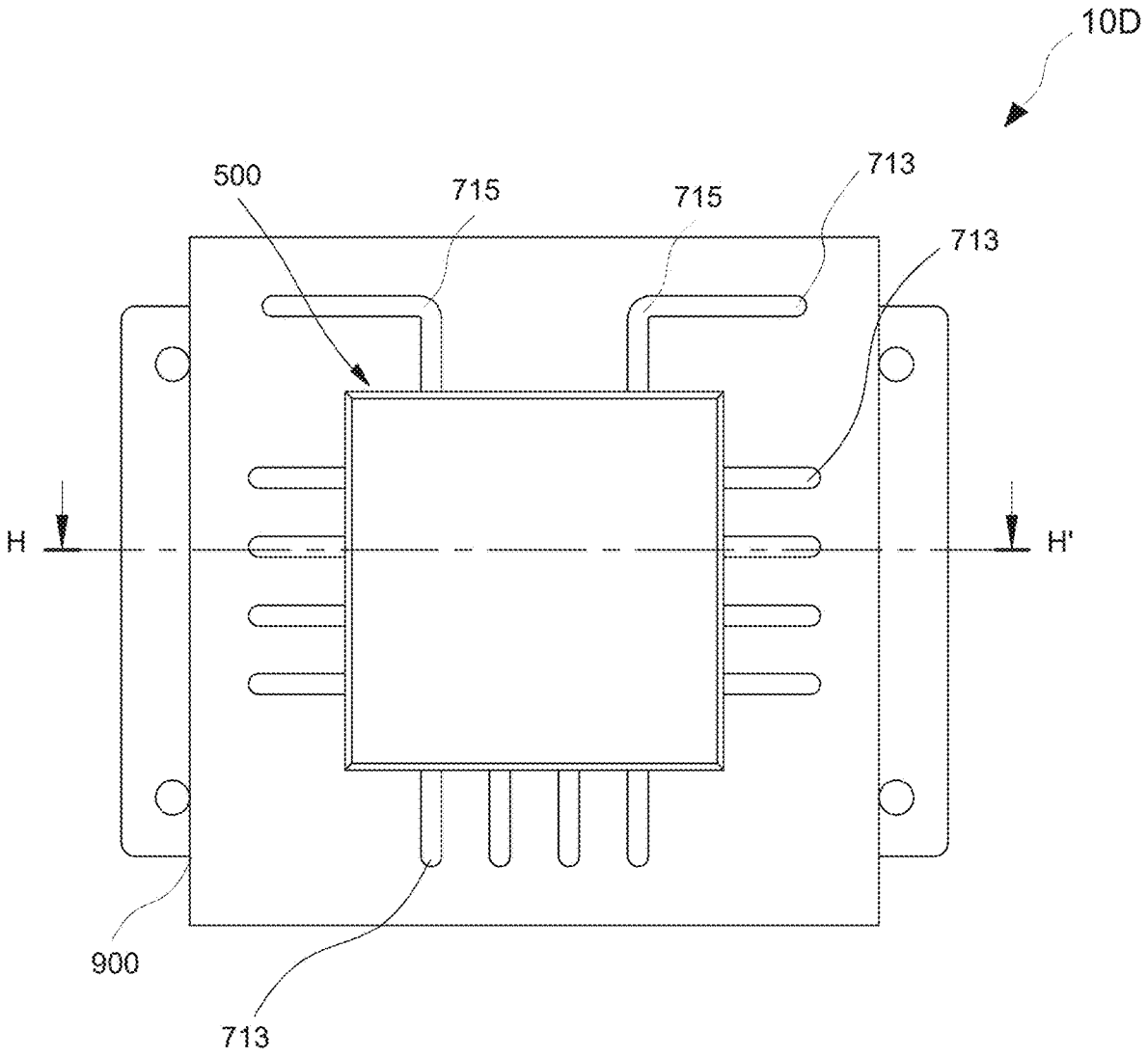
FIG. 16A illustrates a perspective view of the further yet another loop thermosiphon assembly of FIG. 12 and a cross-sectional view H-H' line, in accordance with various embodiments of the present disclosure.
Figure 16B:
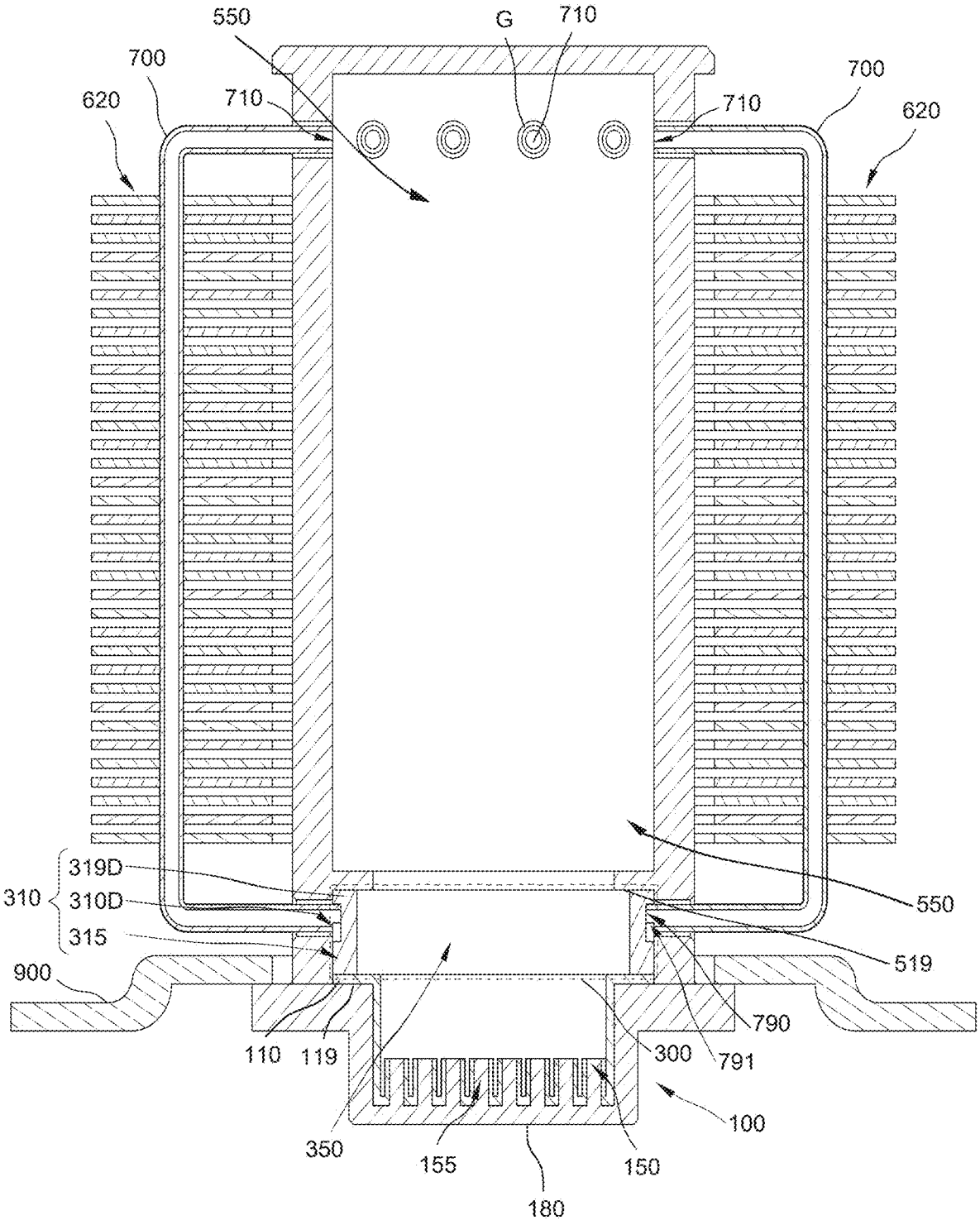
FIG. 16B illustrates a side, cross-sectional view along the H-H' line of the further yet another loop thermosiphon assembly of FIG. 16A, in accordance with various embodiments of the present disclosure.

FIG. 5 illustrates the side, cross-sectional view along the B-B' line of the loop thermosiphon assembly 10, in accordance with various embodiments of the present disclosure. As an example, when the loop thermosiphon assemblies of the present disclosure are in use, heat is transferred from the heat source (not shown) into the heat exchange chamber 150 of the thermal interface component 100 via interior walls of the flat interface surface 190 and the plurality of heat transfer fins 155. Heat transfers from the interior walls and the plurality of heat transfer fins 155 to the capillary wicking layer 110 and then to the liquid coolant inside of the heat exchange chamber 150. The heat causes the liquid coolant to vaporize. The vaporized liquid coolant travels to the input end 710 of the one or more coolant pipes 700 via the second vapor channel 350 and the first vapor channel 550. The temperature difference within the one or more coolant pipes 700 causes the vaporized coolant to liquify. The heat exchanger 620 causes heat from liquified vapor coolant to dissipate to the air that flows past the one or more coolant pipes 700 and the plurality of stacked horizontal fins. Liquified vapor coolant flows to the heat exchange chamber 150 of the thermal interface component 100 via the output end 790 of the one or more coolant pipes 700 and the vapor barrier 310. Heat transfer rates of the loop thermosiphon assemblies of the present disclosure are higher than heat transfer rates of similar or like loop thermosiphon assemblies which do not include the channel 300 and related embodiments and features of the present disclosure.

FIGS. 6 to 8B illustrate another loop thermosiphon assembly 10, in accordance with various embodiments of the present disclosure. The yet another loop thermosiphon assembly 10B may be similar in some respects to the loop thermosiphon assembly 10 of FIGS. 1A to 4B, and therefore may be best understood with reference thereto where like numerals designate like components not described again in detail. In some embodiments, a vapor barrier 310 of a loop thermosiphon assembly 10 of a second configuration includes a solid barrier 319, a plurality of support posts (not shown), and a plurality of gaps (not shown). The solid barrier 319 lines the porous lining 310B opposite the output end 790 and is configured to separate the vaporized liquid coolant from the output end 790 and the porous lining 310B. The solid barrier 319 is coupled to the top ledge 119 of the thermal interface component 100 via the plurality of support posts. Each plurality of gaps is positioned between each neighboring plurality of support posts. The capillary wicking layer 110 is within the plurality of gaps and configured to enable liquified vapor coolant to be directed from the output end 790 to the thermal interface component 100.

FIGS. 9 to 11B illustrate yet another loop thermosiphon assembly 10, in accordance with various embodiments of the present disclosure. The yet another loop thermosiphon assembly 10 may be similar in some respects to the loop thermosiphon assembly 10 of FIGS. 1A to 4B, and therefore may be best understood with reference thereto where like numerals designate like components not described again in detail. In some embodiments, a vapor barrier 310 of a loop thermosiphon assembly 10 of a third configuration includes a solid barrier 319, a chamber pocket 310C, a plurality of support posts (not shown), and a plurality of gaps (not shown). The solid barrier 319 is configured to separate the vaporized liquid coolant from the output end 790 and the chamber pocket 310C. The solid barrier 319 is coupled to the top ledge 119 of the thermal interface component 100 via the plurality of support posts. Each plurality of gaps is positioned between each neighboring plurality of support posts. The capillary wicking layer 110 is within the plurality of gaps and the chamber pocket 310C and the capillary wicking layer 110 are configured to enable liquified vapor coolant to be directed from the output end 790 to the thermal interface component 100.

FIGS. 12 to 16B illustrate further yet another loop thermosiphon assembly 10, in accordance with various embodiments of the present disclosure. The yet another loop thermosiphon assembly 10 may be similar in some respects to the loop thermosiphon assembly 10 of FIGS. 1A to 4B, and therefore may be best understood with reference thereto where like numerals designate like components not described again in detail. In some embodiments, a vapor barrier 310 of a loop thermosiphon assembly 10D of a fourth configuration includes a modified solid barrier 319D, a plurality of chamber pockets 310D, a plurality of support posts (not shown), and a plurality of gaps (not shown). The modified solid barrier 319D is configured to separate the vaporized liquid coolant from the output end 790 and the plurality of chamber pockets 310D. The modified solid barrier 319D is coupled to the top ledge 119 of the thermal interface component 100 via the plurality of support posts. Each plurality of gaps is positioned between each neighboring plurality of support posts. Each plurality of chamber pockets 310D includes a plurality of flow channel structures 315 coupled to the modified solid barrier 319D. The output end 790 of the one or more coolant pipes 700 includes a cut out 791. The capillary wicking layer 110 is within the plurality of gaps and the plurality of flow channel structures 315 of the plurality of chamber pockets 310D and the capillary wicking layer 110 are configured to enable liquified vapor coolant to be directed from the cut out 791 of the output end 790 to the thermal interface component 100.

Heat transfer rates of the loop thermosiphon assemblies 10/10B/10C/10D of the present disclosure are higher than heat transfer rates of similar or like loop thermosiphon assemblies which do not include the channel 300 and related embodiments and features of the present disclosure. The output end 790 of the one or more coolant pipes 700 is coupled to the vapor barrier 310 and not to the heat exchange chamber 150 to enable more turbulent filling of the heat exchange chamber 150 via gravity, thus increasing evaporation rate. When the vaporized liquid coolant is travelling through the second vapor channel 350, the vapor barrier 310 mitigates and prevents the vaporized liquid coolant from travelling to the output end 790, enhancing vapor flow rate. Furthermore, the inner ledge 519 prevents liquified vapor coolant from the first vapor channel 550 from flowing down to the output end 790 of the one or more coolant pipes 700, assuring flow of liquified vapor coolant from the output end 790 to the heat exchange chamber 150. The plurality of stacked horizontal fins coupled to respective vertical portions 750 of the one or more coolant pipes 700 efficiently dissipates heat from liquified vapor coolant inside of the one or more coolant pipes 700 to air that flows past the plurality of stacked horizontal fins. Furthermore, the plurality of capillary pores of the capillary wicking layer 110 has a smaller pore size than the plurality of pores of the porous lining 310A, enabling a higher capillary pressure within the plurality of capillary pores. Liquified vapor coolant travelling to the heat exchange chamber 150 is prevented from travelling back up the plurality of pores, maximizing filling of the heat exchange chamber 150. Turbulent filling occurs in the heat exchange chamber 150 with the output end 790 coupled to the vapor barrier 310. The output end 790 being separate from the second vapor channel 350 increases evaporation rate and filling ratio, mitigating and preventing dry out during high heat flux and mitigating and preventing flooding which limits maximum heat flow rates. The filling ratio and the coolant flow rate is raised, increasing heat transfer rates and enhancing the efficiency of the loop thermosiphon assemblies 10/10B/10C/10D of the present disclosure, while preventing dry out and flooding.

Therefore, embodiments disclosed herein are well adapted to attain the ends and advantages mentioned as well as those that are inherent therein. The particular embodiments disclosed above are illustrative only, as the embodiments disclosed may be modified and practiced in different but equivalent manners apparent to those of ordinary skill in the relevant art having the benefit of the teachings herein.

Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some number. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

The invention claimed is:

1. A loop thermosiphon assembly comprising:

a thermal interface component configured to be coupled to a heat source to be cooled via the thermal interface component, the thermal interface component comprising a liquid coolant;

a channel coupled to the thermal interface component, the channel comprising a vapor barrier and a second vapor channel, the channel coupled to the thermal interface component via the vapor barrier and the second vapor channel;

a first vapor channel coupled to the channel, the first vapor channel is being in communication with the thermal interface component via the second vapor channel; and one or more coolant pipes coupled to the first vapor channel and the vapor barrier, the one or more coolant pipes comprising an input end and an output end, the one or more coolant pipes directly coupled to the first vapor channel via the input end and the one or more coolant pipes directly coupled to the vapor barrier via the output end, the output end in communication with the thermal interface component via the vapor barrier, wherein the second vapor channel and the first vapor channel direct vaporized liquid coolant away from the thermal interface component and the heat source, and wherein the one or more coolant pipes and the vapor barrier direct liquified vapor coolant toward the thermal interface component and the heat source.

2. The loop thermosiphon assembly as claimed in claim 1, wherein the thermal interface component comprises a flat interface surface and a heat exchange chamber, the heat exchange chamber opposite the flat interface surface, the flat interface surface in thermal communication with the heat source.

3. The loop thermosiphon assembly as claimed in claim 2, wherein the heat exchange chamber comprises a plurality of heat transfer fins.

4. The loop thermosiphon assembly as claimed in claim 3, wherein the plurality of heat transfer fins comprises one or more pin fins, the one or more pin fins substantially perpendicular to the heat source.

5. The loop thermosiphon assembly as claimed in claim 3, wherein the vapor barrier comprises a porous lining, the porous lining comprising a plurality of pores configured to enable the liquified vapor coolant to be directed from the output end to the thermal interface component via the porous lining.

6. The loop thermosiphon assembly as claimed in claim 5, wherein the porous lining comprises a metal foam lining.

7. The loop thermosiphon assembly as claimed in claim 5, wherein the heat exchange chamber comprises a capillary wicking layer, the capillary wicking layer overlaying surfaces of the heat exchange chamber and the plurality of heat transfer fins, the capillary wicking layer comprising a plurality of capillary pores.

8. The loop thermosiphon assembly as claimed in claim 7, wherein the porous lining is coupled to the capillary wicking layer, allowing the liquified vapor coolant to flow through the plurality of pores of the porous lining to the plurality of capillary pores of the capillary wicking layer.

9. The loop thermosiphon assembly as claimed in claim 7, wherein the capillary wicking layer comprises a sintered metal wick structure.

10. The loop thermosiphon assembly as claimed in claim 7, wherein the plurality of capillary pores has a smaller pore size than the plurality of pores.

11. The loop thermosiphon assembly as claimed in claim 1, further comprising a heat exchanger coupled to the one or more coolant pipes, the heat exchanger comprising a plurality of stacked horizontal fins.

12. The loop thermosiphon assembly as claimed in claim 1, wherein the one or more coolant pipes comprises fourteen coolant pipes.

13. The loop thermosiphon assembly as claimed in claim 12, wherein the first vapor channel and the channel define a vapor chamber, the vapor chamber comprising a first side, a second side, a third side and a fourth side, the first side coupled to the second side at a perimeter edge of the first side, the first side coupled to the fourth side at a perimeter edge opposite the perimeter edge coupled to the second side, the second side coupled to the third side at a perimeter edge opposite the perimeter edge coupled to the first side, and the third side coupled to the fourth side at a perimeter edge opposite the perimeter edge coupled to the second side, two coolant pipes of the fourteen coolant pipes are coupled to at least one of the first side, the second side, the third side, and the fourth side, each of the two coolant pipes comprising two bends in an horizontal direction enabling the two coolant pipes to protrude in opposing directions extending beyond planes of opposing perimeter edges of the at least one of the first side, the second side, the third side, and the fourth side.

14. The loop thermosiphon assembly as claimed in claim 2, wherein the vapor barrier comprises a solid barrier and a chamber pocket, the chamber pocket configured to enable the liquified vapor coolant to be directed from the output end to the thermal interface component, the solid barrier configured to separate the vaporized liquid coolant from the output end and the chamber pocket.

15. The loop thermosiphon assembly as claimed in claim 2, wherein the vapor barrier comprises a modified solid barrier and a plurality of chamber pockets, each plurality of chamber pockets comprises a plurality of flow channel structures coupled to the modified solid barrier, the plurality of flow channel structures configured to enable the liquified vapor coolant to be directed from the output end to the thermal interface component, the modified solid barrier configured to separate the vaporized liquid coolant from the output end and the plurality of chamber pockets.

16. The loop thermosiphon assembly as claimed in claim 5, wherein the vapor barrier comprises a solid barrier, the solid barrier lining the porous lining opposite the output end, the solid barrier configured to separate the vaporized liquid coolant from the output end and the porous lining.

17. The loop thermosiphon assembly as claimed in claim 1, wherein the one or more coolant pipes comprise one or more portions directing the liquified vapor coolant substantially perpendicular to the thermal interface component and the heat source.

18. The loop thermosiphon assembly as claimed in claim 1, wherein the thermal interface component comprises a cold plate formed with a metal.

19. The loop thermosiphon assembly as claimed in claim 1, wherein the vapor barrier extends substantially perpendicular to the thermal interface component.

20. The loop thermosiphon assembly as claimed in claim 1, wherein a cross-sectional area or a diameter of the first vapor channel is larger than that of at least one of the coolant pipes.

* * * * *